US010399802B2

(12) United States Patent
Hayayumi et al.

(10) Patent No.: US 10,399,802 B2
(45) Date of Patent: Sep. 3, 2019

(54) SHEET FEEDING APPARATUS AND IMAGE FORMING APPARATUS

(71) Applicant: CANON KABUSHIKI KAISHA, Tokyo (JP)

(72) Inventors: Fumihiko Hayayumi, Abiko (JP); Toshiki Ishida, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/928,296

(22) Filed: Mar. 22, 2018

(65) Prior Publication Data

US 2018/0307174 A1 Oct. 25, 2018

(30) Foreign Application Priority Data

Apr. 21, 2017 (JP) ..... 2017-084867

(51) Int. Cl.
*B65H 1/14* (2006.01)
*G03G 15/00* (2006.01)
*B65H 1/26* (2006.01)

(52) U.S. Cl.
CPC ..... *B65H 1/14* (2013.01); *B65H 1/266* (2013.01); *G03G 15/6502* (2013.01); *B65H 2403/41* (2013.01); *B65H 2403/60* (2013.01); *B65H 2405/1117* (2013.01); *G03G 2215/0067* (2013.01)

(58) Field of Classification Search
CPC .. B65H 1/14; B65H 2405/32; B65H 2405/31; B65H 2403/60; G03G 15/6502; G03G 2215/0067
USPC ..... 271/147, 157, 162, 164
See application file for complete search history.

(56) References Cited

U.S. PATENT DOCUMENTS 5,157,448 A * 10/1992 Lang ..... G03G 15/6502 271/157
8,523,173 B2 9/2013 Hayayumi
8,888,092 B2 11/2014 Hayayumi
9,254,973 B2 2/2016 Ishida et al.
9,327,926 B2 5/2016 Chiba
9,637,329 B2 5/2017 Hayayumi
(Continued)

FOREIGN PATENT DOCUMENTS

JP H08-127434 A 5/1996
JP H09-216738 A 8/1997
(Continued)

*Primary Examiner* — David H Bollinger
(74) *Attorney, Agent, or Firm* — Venable LLP

(57) ABSTRACT

A sheet feeding apparatus includes a damper mechanism having a movable portion supported by a sheet storage portion and movable with respect to the sheet storage portion by abutting against a body in a case where the sheet storage portion is inserted to the body, and a resistance member. In addition, a first transmission portion actuates the resistance member to produce a resistive force and transmits the resistive force so that an insertion speed of the sheet storage portion is reduced when the sheet storage portion is inserted to the body, and a second transmission actuates the resistance member to produce the resistive force and transmits the resistive force so that a lowering speed of the sheet supporting member is reduced when the sheet storage portion with the sheet supporting member having been lifted by a lift portion is drawn out of the body.

15 Claims, 11 Drawing Sheets

(56) References Cited

U.S. PATENT DOCUMENTS

| | | | | |
|---|---|---|---|---|
| 9,714,146 | B2 | 7/2017 | Ishida et al. | |
| 2007/0120315 | A1* | 5/2007 | Steinhilber ..... | B65H 3/0615<br>271/109 |

FOREIGN PATENT DOCUMENTS

| | | | |
|---|---|---|---|
| JP | 2005-263346 | A | 9/2005 |
| JP | 2015-214424 | A | 12/2015 |
| JP | 2016-124699 | A | 7/2016 |

* cited by examiner

SHEET FEEDING APPARATUS AND IMAGE FORMING APPARATUS

BACKGROUND OF THE INVENTION

Field of the Invention

The present invention relates to a sheet feeding apparatus for feeding sheets, and an image forming apparatus for forming images on sheets.

Description of the Related Art

In image forming apparatuses such as printers and copying machines, sheet feeding apparatuses equipped with a sheet feeding cassette that can be inserted in a drawable manner to the apparatus body and capable of feeding sheets stored in the cassette are used. In this type of sheet feeding apparatus, there are cases where a damper mechanism is arranged on the sheet feeding cassette or the apparatus body to prevent inconveniences such as displacement of sheets, damage of components and collision noise that may be caused when inserting the sheet feeding cassette to the apparatus body. Japanese Patent Laid-Open Publication No 2015-214424 discloses a sheet feeding apparatus having a dashpot-type oil damper and a pivot member arranged on a sheet feeding cassette, in which the pivot member activates the oil damper when abutted against an apparatus body.

Meanwhile, some sheet feeding apparatuses are equipped with a supporting member referred to as a supporting plate or an intermediate plate that may be lifted with respect to the sheet feeding cassette while supporting sheets. In many cases, this type of supporting member is lifted by drive force from a motor arranged on the apparatus body, and if the sheet feeding cassette is drawn out of the apparatus body, the supporting member is uncoupled from the motor and is lowered by its own weight. If the supporting member is lowered in a state close to free fall, the supporting member collides against a bottom portion of the sheet feeding cassette and problems such as displacement of sheets and collision noise may occur. Japanese Patent Application Laid-Open Publication No. H08-127434 discloses a configuration having a sheet supporting plate suspended by a wire rope, wherein a winding shaft of the wire rope is connected to a rotation-type oil damper, by which lowering action of the sheet supporting plate is damped.

One may consider implementing, in a single sheet feeding apparatus, both a shock absorbing function exerted during insertion of the sheet feeding cassette to the apparatus body and a function to reduce lowering speed of the supporting member during draw-out of the sheet feeding cassette from the apparatus body. Thereby, it is expected that a sheet feeding apparatus having a high usability and capable of overcoming inconveniences such as displacement of sheets both during draw-out of the sheet feeding cassette from the apparatus body and insertion thereof into the apparatus body can be achieved. However, if the configurations disclosed in the above-described documents are combined, providing two oil dampers exerting each functions will be needed, which leads to increase of costs.

SUMMARY OF THE INVENTION

The present invention aims at providing a sheet feeding apparatus that enhances usability while saving costs.

According to one aspect of the present invention, a sheet feeding apparatus includes: a body; a sheet storage portion configured to store a sheet and inserted to the body; a sheet supporting member configured to support the sheet and liftable with respect to the sheet storage portion; a lift portion configured to lift the sheet supporting member with respect to the sheet storage portion; and a damper mechanism including: a movable portion supported by the sheet storage portion and configured to be moved with respect to the sheet storage portion by abutting against the body in a case where the sheet storage portion is inserted to the body; and a resistance member configured to produce resistive force, wherein the damper mechanism is configured to resist, at least temporarily, inserting movement of the sheet storage portion by applying resistive force produced by the resistance member to the movable portion in a case where the sheet storage portion is inserted to the body, and wherein the damper mechanism is configured to resist, at least temporarily, lowering movement of the sheet supporting member by applying resistive force produced by the resistance member to the sheet supporting portion in a case where the sheet storage portion with the sheet supporting member having been lifted by the lift portion is drawn out of the body.

According to another aspect of the present invention, an image forming apparatus includes: a body; an image forming portion provided in the body and configured to form an image on a sheet; and a sheet feeding apparatus configured to feed a sheet to the image forming portion, the sheet feeding apparatus including: a sheet storage portion configured to store a sheet and inserted to the body; a sheet supporting member configured to support the sheet and liftable with respect to the sheet storage portion; a lift portion configured to lift the sheet supporting member with respect to the sheet storage portion; and a damper mechanism including: a movable portion supported by the sheet storage portion and configured to be moved with respect to the sheet storage portion by abutting against the body in a case where the sheet storage portion is inserted to the body; and a resistance member configured to produce resistive force, wherein the damper mechanism is configured to resist, at least temporarily, inserting movement of the sheet storage portion by applying resistive force produced by the resistance member to the movable portion in a case where the sheet storage portion is inserted to the body, and wherein the damper mechanism is configured to resist, at least temporarily, lowering movement of the sheet supporting member by applying resistive force produced by the resistance member to the sheet supporting portion in a case where the sheet storage portion with the sheet supporting member having been lifted by the lift portion is drawn out of the body.

Further features of the present invention will become apparent from the following description of exemplary embodiments with reference to the attached drawings.

DESCRIPTION OF THE EMBODIMENTS

Figure 1A:
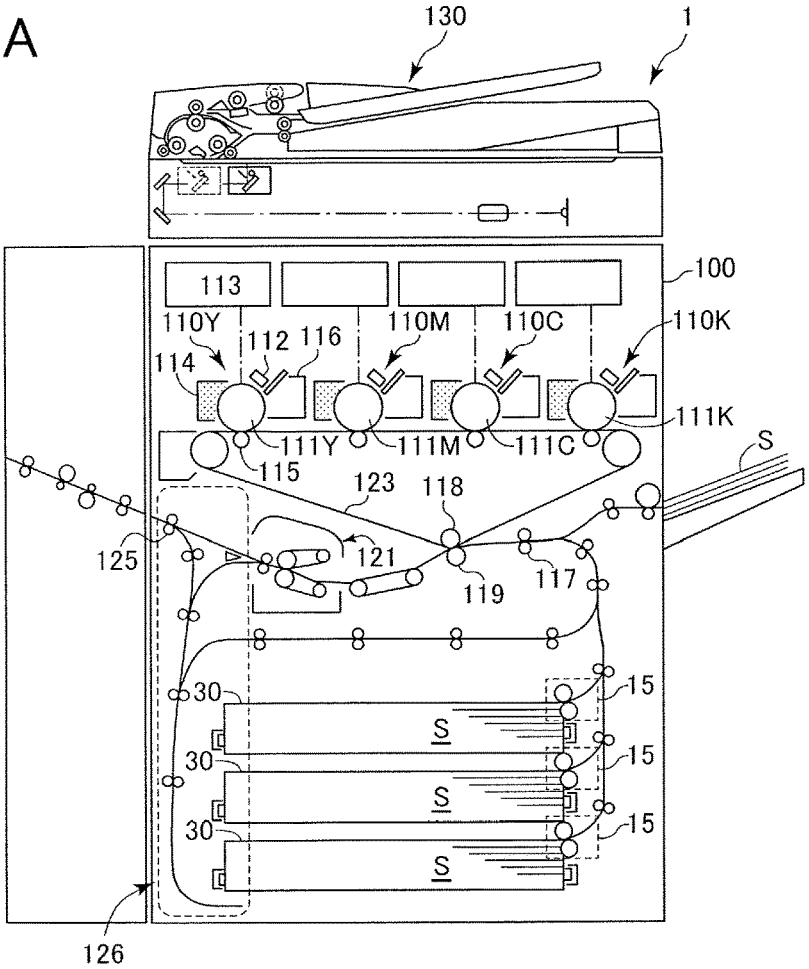
FIG. 1A is a schematic view of an image forming apparatus according to the present disclosure.

An image forming apparatus according to the present disclosure will be described with reference to the drawings. As illustrated in FIG. 1A, an image forming apparatus 1 is a multifunction printer equipped with an image forming engine adopting an electrophotographic system. The image forming apparatus 1 forms an image on a sheet S based on image information entered from an external computer or image information read from a document by an image reading unit 130. The sheet S refers to recording medium including paper such as print paper and envelopes, plastic films such as overhead projector sheets (OHT), or cloth.

Figure 1B:
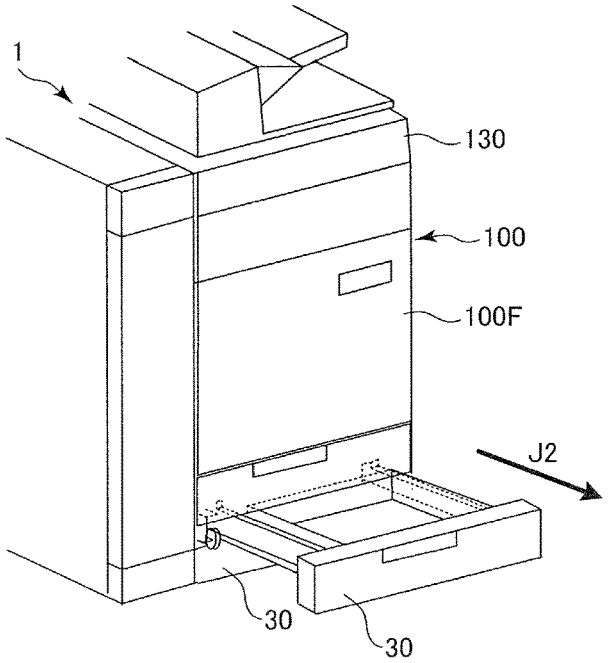
FIG. 1B is a perspective view thereof.

The image forming apparatus 1 includes an apparatus body 100 storing image forming units 110Y, 110M, 110C and 110K each serving as an example of an image forming portion, and a plurality of sheet feeding cassettes (i.e., sheet storages) 30 capable of storing sheets. As illustrated in FIG. 1B, each sheet feeding cassette 30 is drawably inserted to the apparatus body 100 serving as a body of a sheet feeding apparatus, and is drawn out by moving the sheet feeding cassette 30 in a direction referred to as a draw-out direction J2 to the front when viewed from a viewpoint opposed to a front side 100F of the apparatus body 100.

As illustrated in FIG. 1A, the apparatus body 100 includes an image forming engine of a tandem-type intermediate transfer system, including four image forming units 110Y, 110M, 110C and 110K and an intermediate transfer belt 123. Image forming units 110Y through 110K are electrophotographic units respectively equipped with photosensitive drums 111Y, 111M, 111C and 111K, and form toner images of yellow, magenta, cyan and black. The toner images formed by the image forming units 110Y through 110K are transferred to the sheet S through the intermediate transfer belt 123. The configurations of the respective image forming units 110Y through 110K are basically similar except for the differences in the toner color being stored, so that the yellow image forming unit 110Y is taken as an example in describing the configuration of the image forming unit and the forming operation of the toner image.

If a request to start forming toner image to the image forming unit 110Y is received, the photosensitive drum 111Y is driven to rotate, and a charging unit 112 uniformly charges a surface of the photosensitive drum 111Y. An exposing unit 113 arranged on an upper portion of the apparatus body 100 projects laser beams based on image information to the photosensitive drum 111Y to expose the drum surface and forms an electrostatic latent image on the photosensitive drum 111Y. Then, toner supplied from a developing unit 114 visualizes, or develops, the electrostatic latent image, by which a toner image is formed on the photosensitive drum 111Y.

Similarly, toner colors of respective colors are formed on surfaces of photosensitive drums 111M, 111C and 111K in the image forming units 110M, 110C and 110K. The toner images formed in the respective image forming units 110M through 110K are primarily transferred by a primary transfer roller 115 being overlaid on one another on an intermediate transfer belt 123 serving as an intermediate transfer member. Adhesives, such as toner remaining on the photosensitive drums, are removed by cleaning units 116 provided in the respective image forming units 110M, 110C, 110Y and 110K.

The intermediate transfer belt 123 is wound around the primary transfer rollers 115, a secondary transfer inner roller 118, a tension roller and the like, and it is driven to rotate in a direction along with the rotation of the photosensitive drums 111Y through 111K, that is, clockwise direction in FIG. 1A. The toner image borne on the intermediate transfer belt 123 is secondarily transferred to the sheet S at a secondary transfer portion formed by a secondary transfer roller 119 opposed to the secondary transfer inner roller 118 and the intermediate transfer belt 123. Adhesives such as toner remaining on the intermediate transfer belt 123 is removed by a belt cleaning unit. The sheet S on which toner image has been transferred is conveyed to a fixing unit 121. The fixing unit 121 includes a belt conveyance apparatus capable of heating the toner image while nipping and conveying the sheet S, and the fixing unit 121 applies heat and pressure to the toner image to melt the toner and fix the image on the sheet S.

The image forming apparatus 1 serving as a sheet feeding apparatus performs a feeding operation of feeding the sheet S from the sheet feeding cassette 30, simultaneously as performing the above-described image forming process. Sheet feed units 15 corresponding to the respective sheet feeding cassettes 30 are arranged in the apparatus body 100, and the sheet feed units 15 separate the sheet S stored in the sheet feeding cassette 30 one by one and transfer the sheet S toward a registration portion 117.

The registration portion 117 performs skew correction of the sheet S and sends out the sheet S toward the secondary transfer portion along with the advancement of the toner image forming operation performed in the image forming units 110Y through 110K. The sheet S onto which image has been formed by passing through the secondary transfer portion and the fixing unit 121 is discharged to an exterior of the apparatus body 100 by a sheet discharge roller pair 125 and either stacked on a discharge tray or transferred to a sheet processing apparatus such as a binding process device. If duplex printing is to be performed, the sheet S is subjected to switchback at a reverse conveyance portion 126 and re-conveyed toward the registration portion 117 with the front and rear sides of the sheet S switched. The sheet onto which an image has been formed on the rear side is discharged to the exterior of the apparatus body 100 by a sheet discharge roller pair 125.

Sheet Feeding Cassette

Next, a configuration of a sheet feeding cassette according to a configuration for comparison, hereinafter referred to as a comparative example, will be described with reference to FIGS. 9A through 11D. Sheet feeding cassettes 30 as comparative examples differ from first to third embodiments described later in that a damper mechanism (70) that relieves impact caused by insertion of cassette and a damper mechanism (160, 260) that reduces lowering speed of a supporting plate when drawing out the cassette are disposed independently.

Figure 9A:
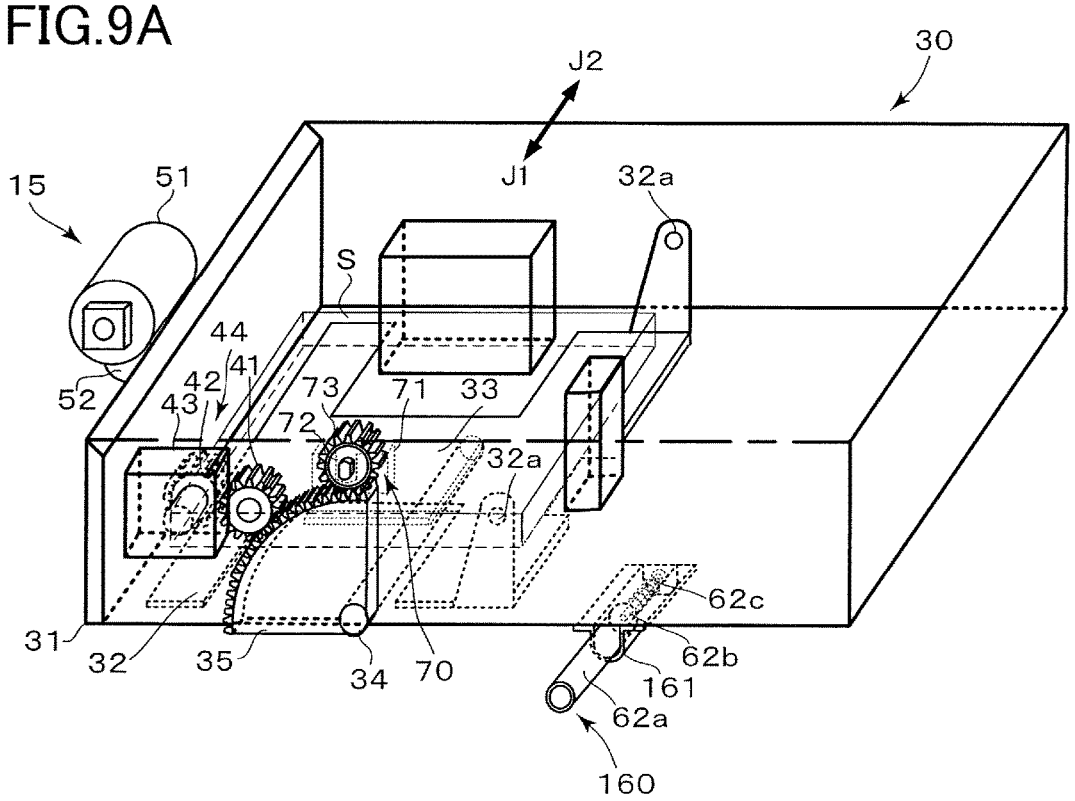
FIG. 9A is a perspective view of a sheet feeding cassette according to a first comparative example.

As illustrated in FIG. 9A, the sheet feeding cassette 30 serving as a sheet storage portion includes a cassette body 31 and a supporting plate 32 that is liftable with respect to the cassette body 31. The sheet feeding cassette 30 can be inserted to and drawn out of the apparatus body by moving in an inserting direction J1 and a draw-out direction J2.

The supporting plate 32 on which the sheet S is supported is a plate-like member pivotable in up-down directions around a pivot shaft 32*a*, and it is lifted by having a lower side pressed by a lifter plate 33. The lifter plate 33 pivots integrally with a lifter gear 35 around a lifter shaft 34. The lifter gear 35 serving as a driven gear is meshed with an idler gear 41 serving as a driving gear, and the idler gear 41 is meshed with an output gear 42 of a lifting motor 43. Therefore, the lifter gear 35 will pivot by driving force received from the lifting motor 43 serving as a driving source and function as a lifting gear that lifts the supporting plate through the lifter plate 33. The supporting plate 32 corresponds to a sheet supporting member liftable with respect to the sheet storage portion while supporting sheets, and the lifter plate 33 corresponds to a lift portion for lifting the sheet supporting member.

A drive unit 44 including the lifting motor 43 and the idler gear 41 is arranged in the apparatus body, and the lifter gear 35 is supported by the sheet feeding cassette 30. Therefore, coupling/uncoupling of the lifter gear 35 and the idler gear 41 serving as a drive transmission portion that transmits driving force from the lifting motor 43 to the lifter gear 35 is switched along with the insertion and draw-out operation of the sheet feeding cassette 30. That is, in a state where the sheet feeding cassette 30 has been inserted to the apparatus body toward the inserting direction J1, the lifter gear 35 is coupled to the lifting motor 43. Further, in a state where the sheet feeding cassette 30 has been drawn out of the apparatus body toward the draw-out direction J2, the lifter gear 35 is separated from the idler gear 41 and uncoupled from the lifting motor 43.

The sheet feed unit 15, which an example of a sheet feeding portion, is supported by the apparatus body and arranged above the supporting plate 32. The sheet feed unit 15 includes a feed roller 51 configured to abut against an upper surface of an uppermost sheet of the sheets S supported on the supporting plate 32, and a separation roller 52 configured to separate the sheet fed by the feed roller 51 from the other sheets. A supported surface detection sensor 53 is arranged in a vicinity of the feed roller 51 as a height detection unit configured to detect whether the uppermost sheet of the sheets S supported on the supporting plate 32 has reached a predetermined height (refer to FIG. 10A). A detection position of the supported surface detection sensor 53 is set such that an upper surface of the uppermost sheet abuts against the feed roller 51 and feeding of the sheet by the feed roller 51 is enabled.

As illustrated in FIG. 9A, the sheet feeding cassette 30 according to the first comparative example is equipped with a rotary damper 70 in a damper mechanism for reducing lowering speed of the supporting plate 32 that is lowered when the sheet feeding cassette 30 is drawn out. The damper 70 is a resistance member including an inner stator 72 fixed to a side plate 71 of the sheet feeding cassette 30 and an outer rotor 73 arranged outside of the inner stator 72, that offers resistance to rotation of the outer rotor 73 by shear resistance of oil or the like sealed in a minute space formed between the inner stator 72 and the outer rotor 73. Gear teeth that mesh with the lifter gear 35 are formed on the outer rotor 73, and resistive force produced by the damper 70 is transmitted through the lifter gear 35 and the lifter plate 33 to the supporting plate 32.

Further, a damper mechanism 160 including a dashpot-type damper 62 as a mechanism for reliving impact during insertion of the cassette is provided on the sheet feeding cassette 30. The damper 62 includes a cylinder 62*a* that moves along the inserting direction J1 and the draw-out direction J2 of the sheet feeding cassette 30, a piston 62*b* fixed to the cassette body 31, and a return spring 62*c* that urges the cylinder 62*a* toward the inserting direction J1. The cylinder 62*a* is supported slidably by a supporting member 161 fixed to the cassette body 31, and the damper 62 is a linear-motion resistance member that expands and contracts linearly (i.e., lengthen and shorten in an operation direction) by sliding movement of the cylinder 62*a*.

The damper 62 is projected from the cassette body 31 toward the inserting direction J1, and contracts by the cylinder 62*a* being abutted against and pressed by the apparatus body along with the inserting operation of the sheet feeding cassette 30. During this operation, resistive force resisting relative movement of the damper and the cassette body 31 is produced as viscous resistance of oil sealed in the damper 62. This resistive force acts as force toward the draw-out direction J2 with respect to the cassette body 31, and attenuates kinetic energy of the sheet feeding cassette 30 in the inserting direction J1.

Figure 9B:
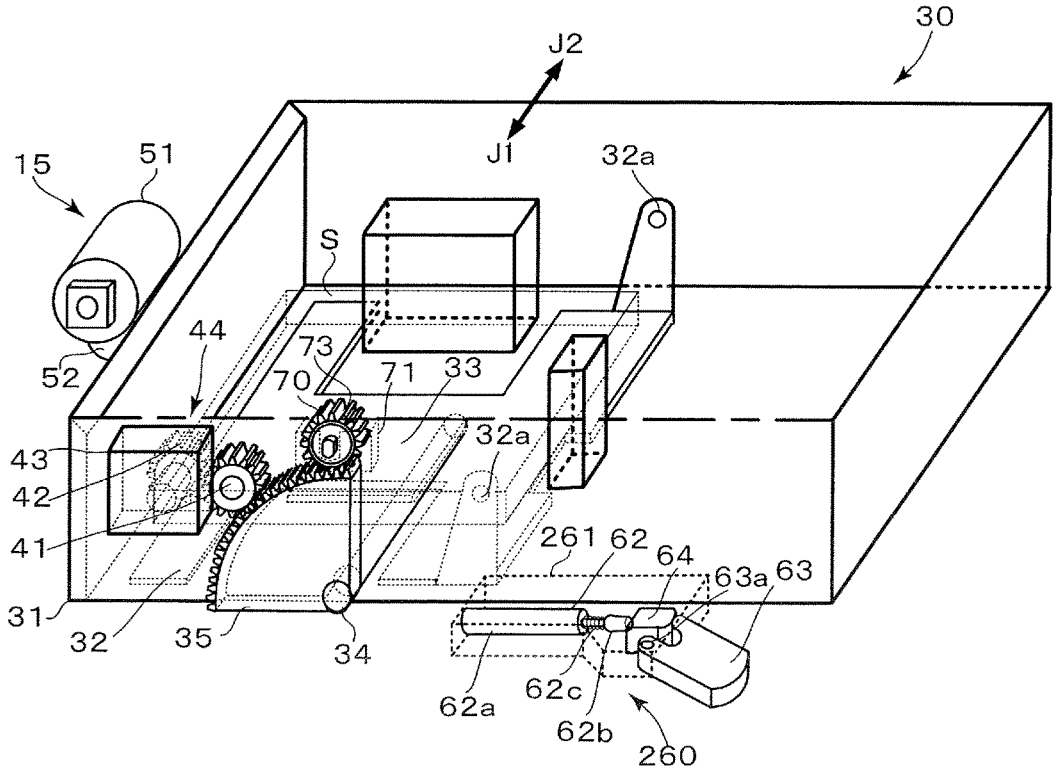
FIG. 9B is a perspective view of a sheet feeding cassette according to a second comparative example.

Meanwhile, another damper mechanism 260 including a dashpot-type damper 62 serving as a mechanism for reliving impact during insertion of cassette is provided on a sheet feeding cassette 30 according to a second comparative example, as illustrated in FIG. 9B. Unlike the first comparative example, the damper 62 according to the damper mechanism 260 is arranged such that the direction of expansion and contraction is parallel with the direction orthogonal to the inserting direction J1, and the piston 62*b* moves in left and right directions in FIG. 9B with respect to the cylinder 62*a*.

The damper mechanism 260 includes a link member serving as a pivot member supported pivotably by a supporting member 261 fixed to the cassette body 31. The link member 63 can move to a projected position projected from the cassette body 31 toward the inserting direction J1 and a retracted position retracted from the projected position to the draw-out direction J2, and is retained at the projected position as an initial position in the state where the sheet feeding cassette 30 is drawn out of the apparatus body. Further, the link member 63 presses the piston 62*b* of the damper 62 through an intermediate member 64 by being pressed by the apparatus body along with the insertion of the sheet feeding cassette 30 to the apparatus body.

Figure 10C:
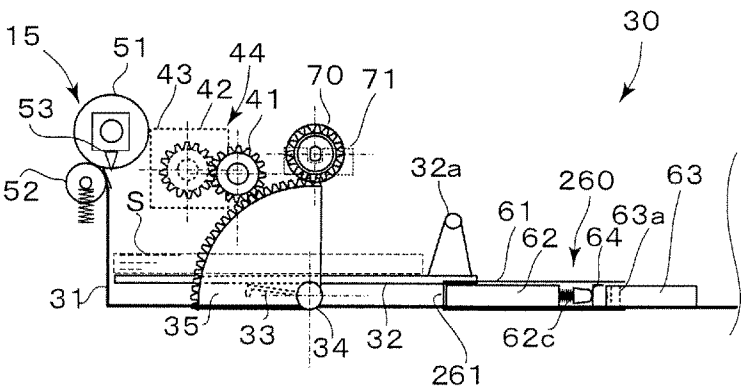
FIG. 10C is a side view illustrating a state after the inserting operation thereof.
Figure 10D:
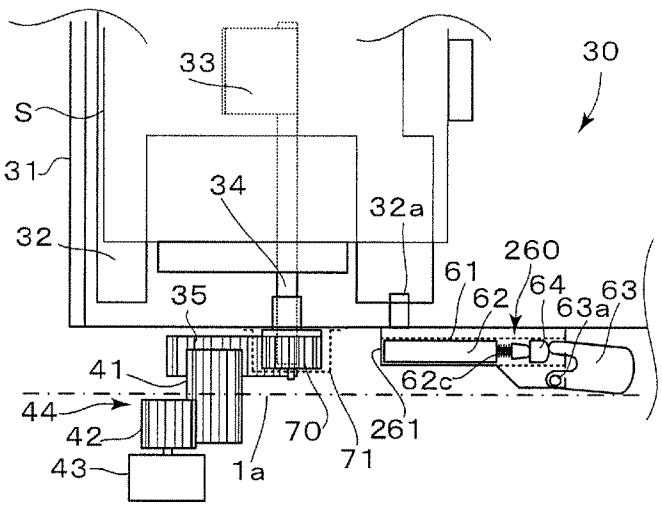
FIG. 10D is an upper view thereof.
Figure 10A:
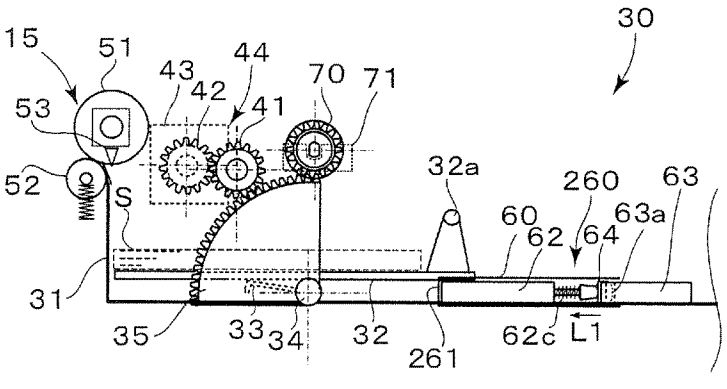
FIG. 10A is a side view illustrating a state in inserting operation of the sheet feeding cassette according to the second comparative example.
Figure 10B:
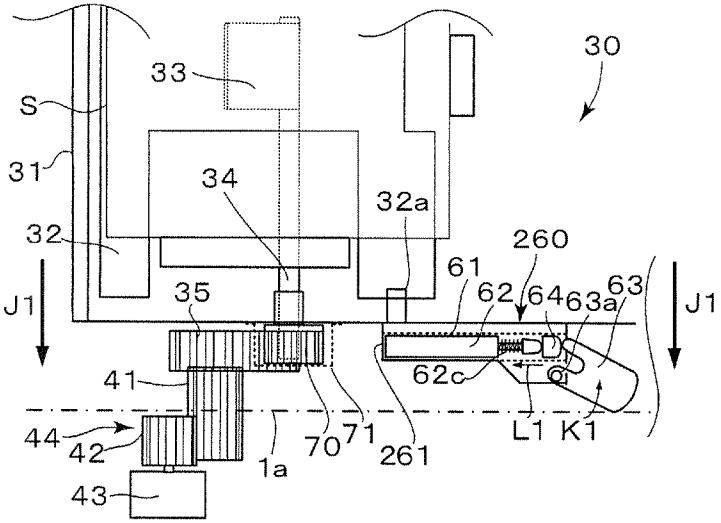
FIG. 10B is an upper view thereof.

Next, an operation of inserting the sheet feeding cassette 30 according to the second comparative example to the apparatus body and an operation of drawing out the cassette from the apparatus body will be described. At first, an inserting operation of the sheet feeding cassette 30 will be described with reference to FIGS. 10A through 10D. FIGS. 10A and 10B illustrate the state in midway of inserting operation of the sheet feeding cassette 30, and FIGS. 10C and 10D illustrate the state after completing the inserting operation. FIGS. 10A and 10C are schematic views in which the sheet feeding cassette 30 is viewed from a downstream side in the inserting direction J1, and FIGS. 10B and 10D are schematic views in which the sheet feeding cassette 30 is viewed from above.

As illustrated in FIGS. 10A and 10B, in the state before the sheet feeding cassette 30 is inserted, the link member 63 is retained at the projected position by urging force of the return spring 62*c*. In a state where the sheet feeding cassette 30 is moved to the inserting direction J1 and inserted to the apparatus body, the lifter gear 35 and the idler gear 41 are meshed and the lifter plate 33 is coupled to the lifting motor 43.

In parallel therewith, the link member 63 at the projected position is abutted against a side plate 1*a* fixed to the apparatus body, is pressed by the side plate 1*a* and pivots in a direction of arrow K1 around a support shaft 63*a*. Along therewith, the intermediate member 64 pressed by the link member 63 moves in the direction of arrow L1, and the piston 62*b* receives force to move leftward in the drawing. Since the movement of the cylinder 62*a* is restricted by the supporting member 261, the piston 62*b* is pushed into the cylinder 62*a*. Here, the piston 62*b* is pushed against viscous resistance of oil sealed in the cylinder 62*a*, and a portion of kinetic energy of the sheet feeding cassette 30 is consumed by doing the work of shortening the damper 62. That is, since the damper 62 resists the relative movement of the cassette body 31 and the link member 63, moving speed of the sheet feeding cassette 30 is reduced compared to the case where the damper mechanism 260 is not provided. Thereby, occurrence of sheet displacement, component damage and collision noise caused by the collision of the sheet feeding cassette 30 and the apparatus body is reduced.

As illustrated in FIGS. 10C and 10D, in a state where the sheet feeding cassette 30 is inserted to the apparatus body, the link member 63 is pressed by the side plate 1*a* of the apparatus body and retained at the retracted position. In this state, the cylinder 62*a* receives repulsive force from the return spring 62*c* toward the left side in the drawing, but movement of the cylinder is restricted by the supporting member 261.

Figure 11C:
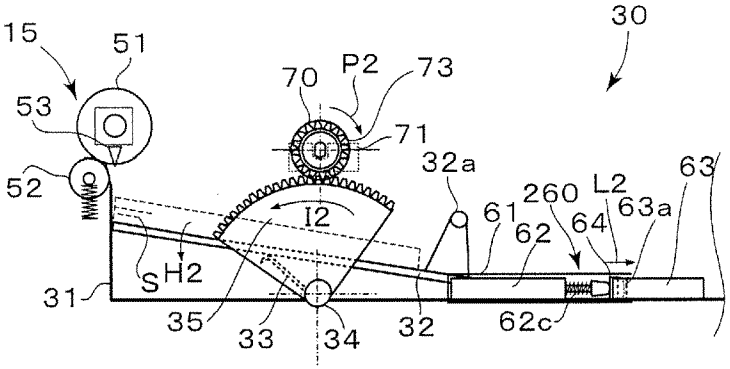
FIG. 11C is a side view illustrating a state in midway of the draw-out operation thereof.
Figure 11A:
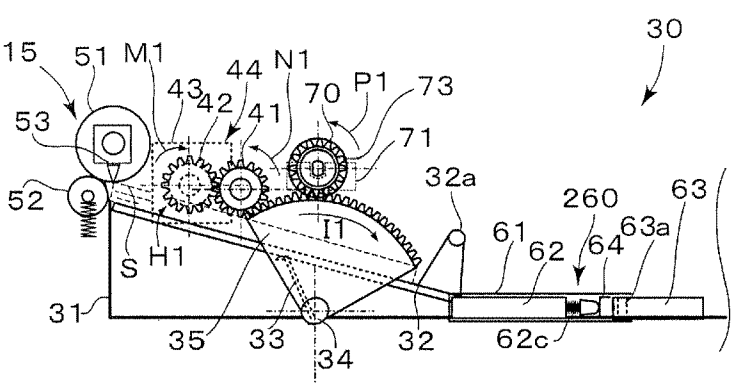
FIG. 11A is a side view illustrating a state of the sheet feeding cassette before being drawn out of the apparatus body according to the second comparative example.
Figure 11D:
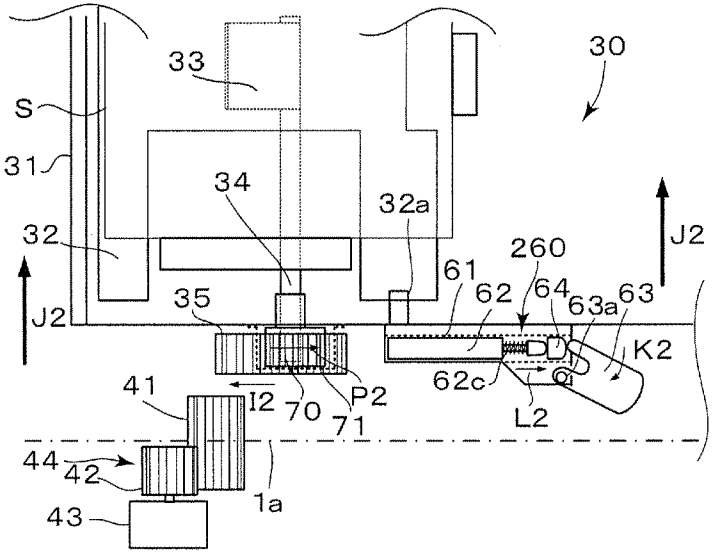
FIG. 11D is an upper view thereof.
Figure 11B:
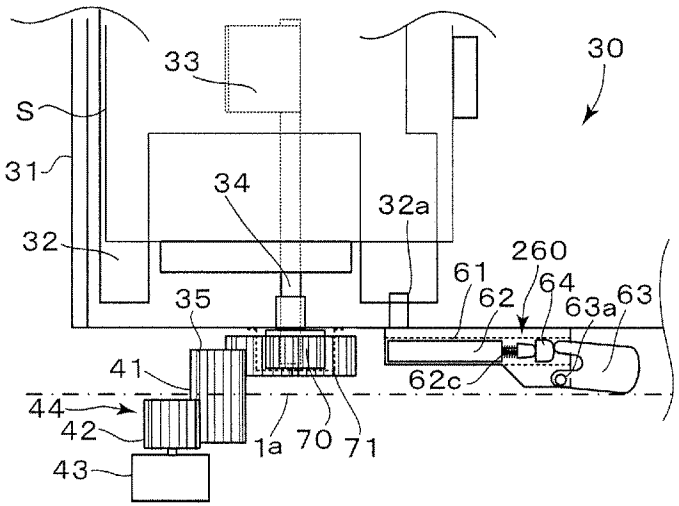
FIG. 11B is an upper view thereof.

Next, the operation of drawing out the sheet feeding cassette 30 from the apparatus body will be described with reference to FIGS. 11A through 11D. FIGS. 11A and 11B illustrate a state of the sheet feeding cassette 30 before being drawn out, and FIGS. 11C and 11D illustrate a state of the sheet feeding cassette 30 in midway of draw-out operation. FIGS. 11A and 11C are schematic views illustrating the sheet feeding cassette 30 from a downstream side in the inserting direction J1, and FIGS. 11B and 11D are schematic views illustrating the sheet feeding cassette 30 from above.

As illustrated in FIGS. 11A and 11B, the lifting motor 43 is started to be driven after the sheet feeding cassette 30 is inserted to the apparatus body. A cassette detection sensor capable of detecting the sheet feeding cassette 30 is arranged on the apparatus body, and the lifting motor 43 is started to be driven based on a detection signal of the cassette detection sensor. The output gear 42, the idler gear 41 and the lifter gear 35 respectively rotate in directions of arrows M1, N1 and I1, by which the supporting plate 32 is lifted in a direction of arrow H1. In this state, the outer rotor 73 of the damper 70 is also rotated in the direction of arrow P1. The lifting motor 43 is stopped if an upper surface of the sheet S is detected by the supported surface detection sensor 53, and the feed roller 51 is started to be driven, by which feeding of the sheet S is started.

As illustrated in FIGS. 11C and 11D, if the sheet feeding cassette 30 is drawn out of the apparatus body along the draw-out direction J2, in order to supply sheets S or for any other reason, the lifter gear 35 is separated from the idler gear 41, and coupling of the lifter plate 33 and the lifting motor 43 is released. Then, the supporting plate 32 starts lowering in the direction of arrow H2 by its own weight and also by the weight of the sheet S, and along therewith, the lifter gear 35 and the outer rotor 73 of the damper 70 are respectively rotated in the directions of arrows 12 and P2. In this state, the outer rotor 73 rotates against viscous resistance of oil sealed in the gap between the inner stator 72, and a portion of the kinetic energy to the downward direction of the supporting plate 32 is consumed by doing the work of rotating the outer rotor 73. That is, the lowering speed of the supporting plate 32 is reduced by the damper 70 offering resistance to the lowering movement of the supporting plate 32, compared to the case where the damper 70 is not provided. Thereby, occurrence of sheet displacement, component damage and collision noise caused by the collision of the sheet feeding cassette 30 and the apparatus body is reduced.

The operation of inserting the sheet feeding cassette 30 to the apparatus body and drawing the cassette out of the apparatus body has been described with reference to the second comparative example, but the operation according to the first comparative example is similar to the second comparative example. As described, according to the configuration of the first and second comparative examples, the first damper mechanisms 160 and 260 for relieving impact when inserting the cassette and the second damper mechanism 70 for reducing the lowering speed of the supporting plate 32 when drawing out the cassette are provided separately. The first and second damper mechanisms are respectively provided with dampers 62 and 70 as resistance members for generating resistive force.

In contrast, the sheet feeding cassette 30 of the sheet feeding apparatus according to the first to third embodiments described hereafter realizes, by resistive force produced by a single resistance member, both absorption of impact caused during insertion of cassette and reducing of lowering speed of the supporting plate. Hereafter, configurations of the respective embodiments will be described in detail.

First Embodiment

First, a configuration of a sheet feeding apparatus according to a first embodiment will be described with reference to FIGS. 2 through 4D. Hereafter, elements that are common to the aforementioned description are denoted with the same reference numbers, and descriptions thereof are omitted.

Figure 2:
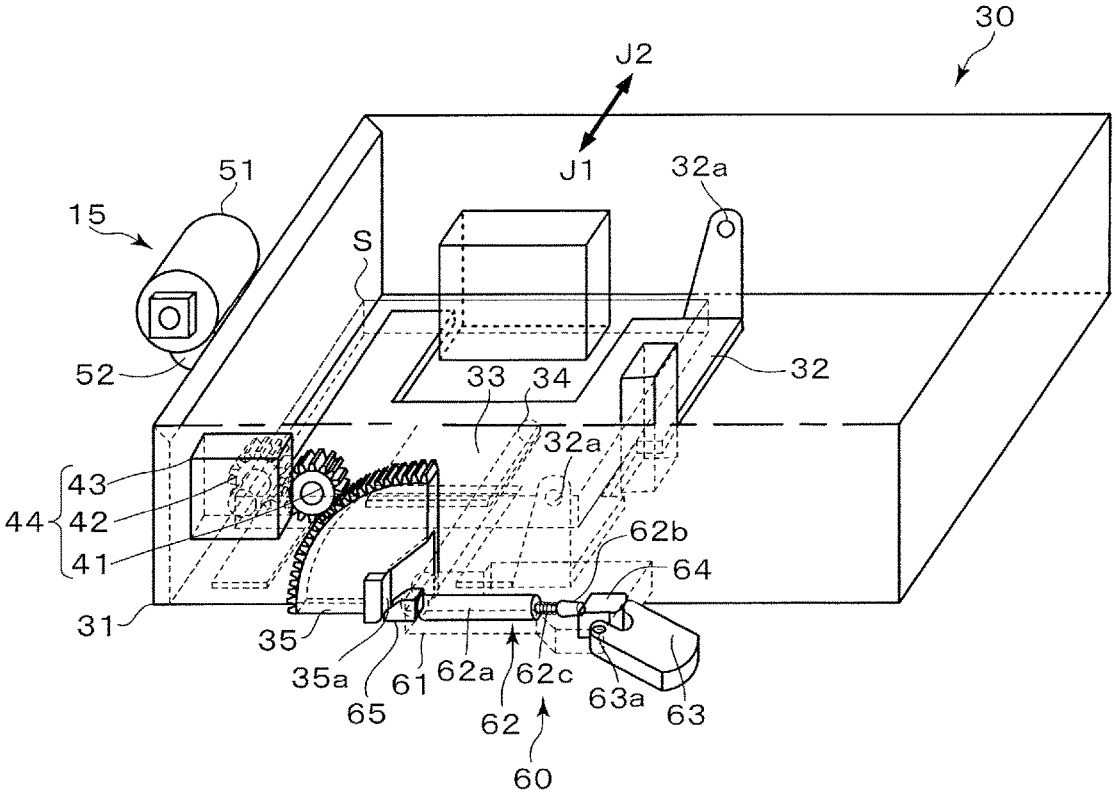
FIG. 2 is a perspective view of a sheet feeding apparatus according to a first embodiment.

FIG. 2 is a perspective view in which the sheet feeding cassette 30 according to the present embodiment is viewed from a rear side of the apparatus body, i.e., downstream side in the inserting direction J1. As illustrated in FIG. 2, the sheet feeding cassette 30 according to the present embodiment is equipped with a damper mechanism 60 including a linear-motion damper 62. The damper 62 includes a cylinder having oil sealed therein, a piston 62*b* movable with respect to the cylinder 62*a*, and a return spring 62*c* arranged in a contracted state between the cylinder 62*a* and the piston 62*b*. The damper 62 can expand and contract, or lengthen and shorten, in a direction orthogonal to the inserting direction J1 of the sheet feeding cassette 30 in a plan view (i.e., right-left direction in the drawing). That is, in the present embodiment, each of the cylinder 62*a* and the piston 62*b* are movable in the sliding direction of the piston 62*b* (i.e., the operation direction of the damper 62).

The damper mechanism 60 includes a link member 63 supported pivotably on the cassette body 31 through the support shaft 63*a* and a supporting member 61. The link member 63 is pivotable between a projected position protruded downstream in the inserting direction J1 from the apparatus body and a retracted position retracted upstream in the inserting direction J1 compared to the projected position. The link member 63 pivots when pressed by the apparatus body along with the inserting operation of the sheet feeding cassette 30, and presses the piston 62*b* of the damper 62 through the intermediate member 64.

In addition to the intermediate member 64 as a first abutment portion that abuts against the damper 62 from one side in the operation direction of the damper 62, the damper mechanism 60 is equipped with an auxiliary intermediate member 65 as a second abutment portion that abuts against the damper 62 from the other side in the operation direction. The auxiliary intermediate member 65 can press the cylinder 62*a* of the damper 62 by sliding along the operation direction of the damper 62 along with movement of the supporting plate 32. The cylinder 62*a* of the damper 62 is supported slidably along the operation direction, i.e., right and left directions in the drawing, by the supporting member 61. Further, the lifter gear 35 is equipped with a cam surface 35*a* capable of pressing the auxiliary intermediate member 65 toward the damper 62.

The damper 62 is an example of a resistance member equipped with the piston 62*b* as the first movable member and the cylinder 62*a* as the second movable member capable of moving relatively with respect to the first movable member. The link member 63 corresponds to a movable portion capable of moving relatively with respect to the sheet storage portion by being pressed by the apparatus body and moves between a projected position corresponding to a first position and a retracted position corresponding to a second position. The return spring 62*c* of the damper 62 is a returning means that returns the damper 62 to an expanded state, and functions as an urging member of urging the link member 63 in the predetermined direction, that is, toward the first position in a movable direction of the link member 63. The intermediate member 64 corresponds to a first transmission portion capable of transmitting the resistive force produced by the resistance member to the movable portion. Further, the auxiliary intermediate member 65 corresponds to a second transmission portion capable of transmitting the resistive force produced by the resistance member to the supporting plate 32 serving as the sheet supporting member.

Figure 3A:
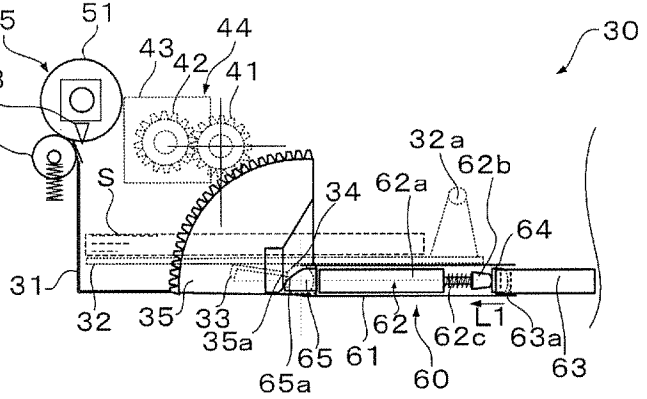
FIG. 3A is a side view illustrating a state in an inserting operation of a sheet feeding cassette according to a first embodiment.
Figure 3B:
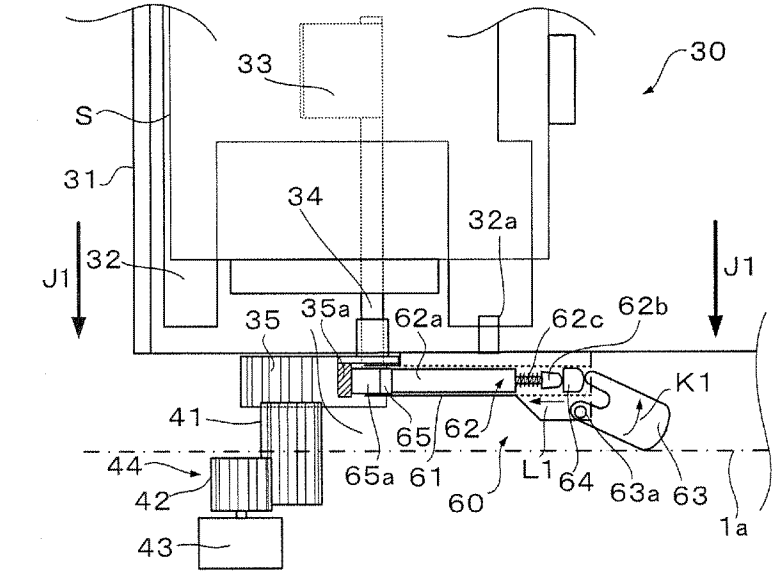
FIG. 3B is an upper view thereof.
Figure 3C:
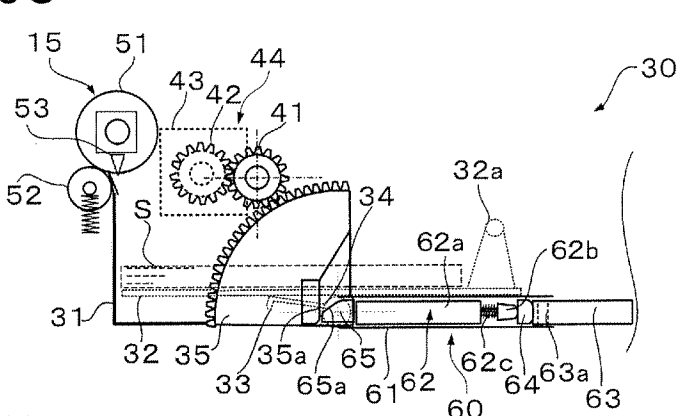
FIG. 3C is a side view illustrating a state after the inserting operation thereof.
Figure 3D:
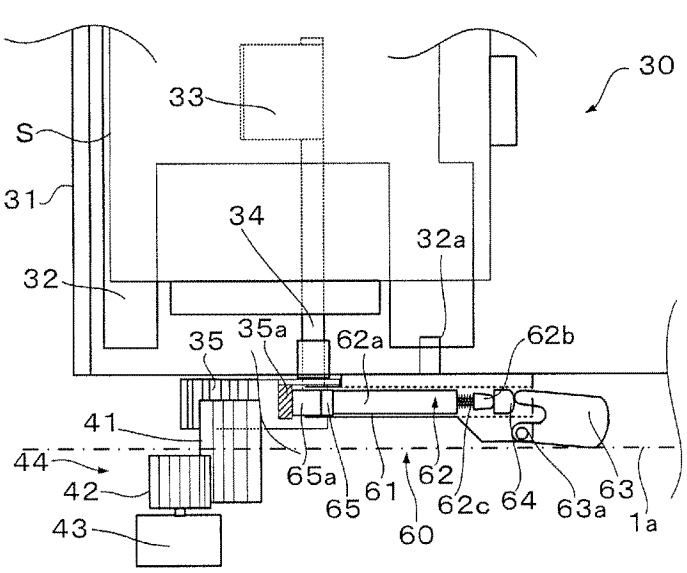
FIG. 3D is an upper view thereof.

The operations of inserting the sheet feeding cassette 30 according to the present embodiment to the apparatus body and drawing the same out of the apparatus body will be described. At first, the inserting operation of the sheet feeding cassette 30 will be described with reference to FIGS. 3A through 3D. FIGS. 3A and 3B illustrate the state in midway of the inserting operation of the sheet feeding cassette 30, and FIGS. 3C and 3D illustrate the state after the inserting operation is completed. FIGS. 3A and 3C are schematic views illustrating the sheet feeding cassette 30 from the downstream side in the inserting direction J1, and FIGS. 3B and 3D are schematic views illustrating the sheet feeding cassette 30 from above.

As illustrated in FIGS. 3A and 3B, in the state before the sheet feeding cassette 30 is inserted, the link member 63 is retained at the projected portion by urging force of the return spring 62*c*. Further, the supporting plate 32 is lowered to a lower position at which downward movement is restricted by the sheet feeding cassette 30, that is, a lower limit position of movable range. In this state, the cam surface 35*a* of the lifter gear 35 is retained at a position perpendicular to the operation direction of the damper 62 and abutted against the auxiliary intermediate member 65.

If the sheet feeding cassette 30 is moved toward the inserting direction J1 and inserted to the apparatus body, the lifter gear 35 and the idler gear 41 are meshed and the lifter plate 33 is coupled to the lifting motor 43. In parallel therewith, the link member 63 at the projected position is abutted against the side plate 1*a* fixed to the apparatus body, is pressed by the side plate 1*a*, and pivots toward the direction of arrow K1 around the support shaft 63*a*. Then, the intermediate member 64 pressed by the link member 63 moves toward the direction of arrow L1 (left side in the drawing) and the piston 62*b* is pushed in toward the left side in the drawing.

In that situation, the auxiliary intermediate member 65 is restricted from moving leftward in the drawing by the cam surface 35*a* and retains the cylinder 62*a* in resistance to the force in which the intermediate member 64 pushes in the piston 62*b*. Since the piston 62*b* is pushed in resistance to the viscous resistance of oil sealed in the cylinder 62*a*, a portion of the kinetic energy of the sheet feeding cassette 30 is consumed by doing the work of shortening the damper 62. That is, the insertion speed of the sheet feeding cassette 30 is reduced by the damper 62 offering resistance, at least temporarily in case where the sheet feeding cassette 30 is being inserted, to the relative movement of the cassette body 31 and the link member 63, compared to the case where the damper mechanism 60 is not provided.

As illustrated in FIGS. 3C and 3D, in a state where the sheet feeding cassette 30 is inserted to the apparatus body, the link member 63 is pressed by the side plate 1*a* of the apparatus body and retained at the retracted position. In this state, the cylinder 62*a* receives repulsive force toward the left side in the drawing from the return spring 62*c*, but movement thereof is restricted by the auxiliary intermediate member 65.

Figure 4A:
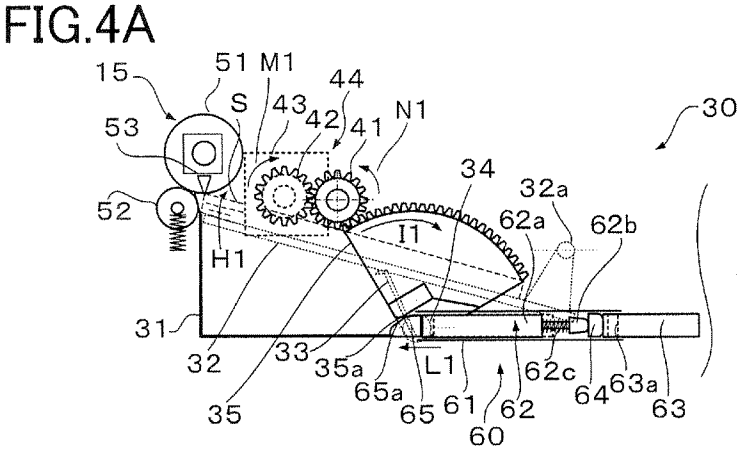
FIG. 4A is a side view illustrating the sheet feeding cassette before being drawn out of the apparatus body according to the first embodiment.
Figure 4B:
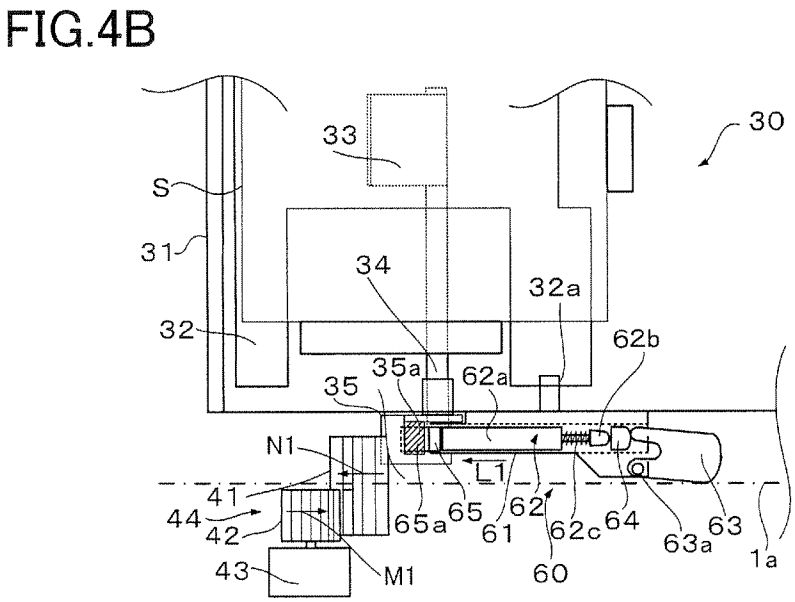
FIG. 4B is an upper view thereof.
Figure 4C:
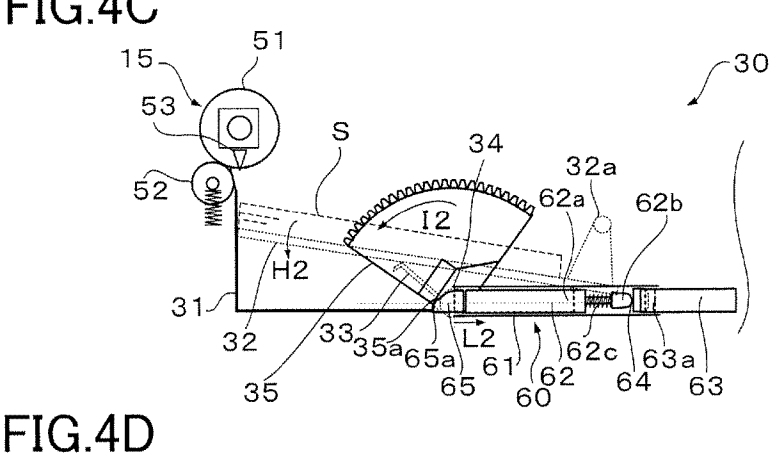
FIG. 4C is a side view illustrating a state in the draw-out operation thereof.
Figure 4D:
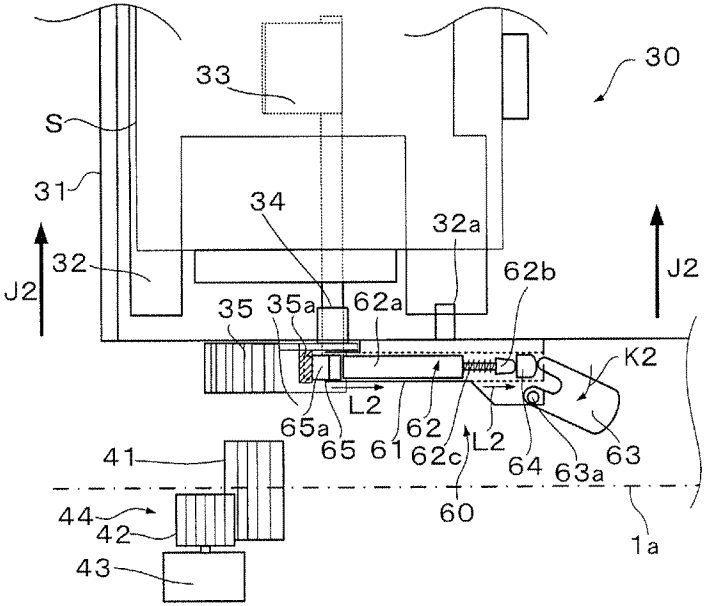
FIG. 4D is an upper view thereof.

Next, the operation of drawing out the sheet feeding cassette 30 from the apparatus body will be described with reference to FIGS. 4A through 4D. FIGS. 4A and 4B illustrate the state before the sheet feeding cassette 30 is drawn out, and FIGS. 4C and 4D illustrate the state in midway of the draw-out operation of the sheet feeding cassette 30. Further, FIGS. 4A and 4C are schematic views illustrating the sheet feeding cassette 30 from a downstream side in the inserting direction J1, and FIGS. 4B and 4D are schematic views illustrating the sheet feeding cassette 30 from above.

As illustrated in FIGS. 4A and 4B, the lifting motor 43 is started to be driven after the sheet feeding cassette 30 is inserted to the apparatus body. The output gear 42, the idler gear 41 and the lifter gear 35 respectively rotate in directions of arrows M1, N1 and I1, by which the supporting plate 32 is lifted toward the direction of arrow H1. The lifting motor 43 is stopped if an upper surface of the sheet S is detected by the supported surface detection sensor 53, and thereafter, the feed roller 51 is started to be driven, thereby feeding of the sheet S is started. Hereafter, an upper limit position of the supporting plate 32 in a state where the sheet feeding cassette 30 is inserted to the apparatus body (e.g., the position of the supporting plate 32 in which an upper surface of the sheet S has been detected by the supported surface detection sensor 53 with a minimum number of sheets S supported thereon) is referred to as the upper position.

Here, along with the operation of the lifter gear 35 rotating in the direction of arrow I1, the cam surface 35*a* also pivots along an abutment surface 65*a* of the auxiliary intermediate member 65. Then, the cam surface 35*a* retracts from a movement path of the auxiliary intermediate member 65, and the cylinder 62*a* and the auxiliary intermediate member 65 of the damper 62 are moved toward the direction of arrow L1 by the urging force of the return spring 62*c*. The shapes of the cam surface 35*a* and the abutment surface 65*a* are set such that the cylinder 62*a* and the auxiliary intermediate member 65 are moved gradually along with the rotation of the lifter gear 35. Then, the damper 62 will be in the expanded state again by the cylinder 62*a* moving toward the direction of arrow L1 with respect to the piston 62*b*.

As illustrated in FIGS. 4C and 4D, if the sheet feeding cassette 30 is drawn out of the apparatus body along the draw-out direction J2, the lifter gear 35 is separated from the idler gear 41, and the drive-coupling of the lifter plate 33 and the lifting motor 43 is released. Then, the supporting plate 32 starts to be lowered toward the direction of arrow H2 by its own weight and also by the weight of the sheet S. In this state, the lifter gear 35 is rotated in the direction of arrow 12 along with the lowering movement of the supporting plate 32, and the cam surface 35*a* presses the auxiliary intermediate member 65 in the direction of arrow L2.

Since the sheet feeding cassette 30 is drawn out of the apparatus body, the link member 63 is separated from the side plate 1*a* of the apparatus body. Therefore, the damper 62 is slid in the direction of arrow L2 by the force of the cam surface 35*a* pressing the auxiliary intermediate member 65, and the link member 63 pivots in the direction of arrow K2 toward the projected position, which is an initial position. The supporting member 61 also serves as a regulating member that regulates the pivoting range of the link member 63, and the link member 63 is restricted from pivoting in the direction of arrow K2 past the projected position, which is the initial position.

Therefore, after the link member 63 has reached the initial position, the lifter gear 35 rotates in the direction of arrow 12 while contracting the damper 62 through the auxiliary intermediate member 65. Since a portion of the kinetic energy to the downward direction of the supporting plate 32 is consumed by doing the work of contracting the damper 62, the lowering speed of the supporting plate 32 is reduced. That is, the lowering speed of the supporting plate 32 is reduced by the damper offering resistance, at least temporarily in a case where the sheet feeding cassette 30 with the supporting plate 32 having been lifted is drawn out, to the lowering movement of the supporting plate 32, compared to the case where the damper mechanism 60 is not provided.

If the supporting plate 32 is lowered to the lower position by the damper mechanism 60, the auxiliary intermediate member 65 will be positioned again by the cam surface 35*a*. In this state, if the sheet feeding cassette 30 is inserted to the apparatus body, as illustrated in FIG. 3, the resistive force produced by the damper 62 damps the inserting operation of the sheet feeding cassette 30.

During the time after the sheet feeding cassette 30 is drawn out of the apparatus body and before the link member 63 reaches the projected position, the damper 62 moves in sliding motion along with the lowering movement of the supporting plate 32, such that this time functions as a waiting time for starting an action of reducing lowering speed of the supporting plate 32. Here, a moving time of the intermediate member 64 needed for the link member 63 to pivot from the retracted position to the projected position is sufficiently small compared to a moving time needed for the auxiliary intermediate member 65 to move along with the supporting plate 32 lowering from the upper position to the lower position. Moreover, the urging force of the return spring 62*c* of the damper 62 is set strong enough to pivot the link member 63 separated from the apparatus body before the supporting plate 32 reaches the lower position. Therefore, the resistive force of the damper 62 is transmitted to the supporting plate 32 at least before the supporting plate 32 reaches the lower position, and an effect of reducing lowering speed of the supporting plate 32 is achieved.

As described, the damper mechanism 60 according to the present embodiment uses the damper 62, which is a common resistance member, to realize relieving of impact during insertion of cassette and moderating of lowering speed of the supporting plate 32 while the cassette is drawn out. Therefore, a sheet feeding apparatus having high usability and capable of overcoming inconveniences such as sheet displacement can be achieved both during draw-out of the sheet feeding cassette 30 from the apparatus body and during insertion thereof to the apparatus body. At the same time, cost saving is achieved compared to the configuration where a plurality of resistance members are arranged to realize the respective damping function, as in the above-described comparative examples.

The damper mechanism 60 according to the present embodiment adopts a configuration in which the state of the damper mechanism 60 is changed according to the position of the supporting plate 32 in a state where the sheet feeding cassette 30 has been drawn out of the apparatus body. That is, if the supporting plate 32 is at the lower position (FIGS. 3A and 3B), a first state is realized in which the intermediate member 64 transmits the resistive force of the damper 62 to the link member 63. If the supporting plate is at the upper position (FIG. 4C and 4D), a second state is realized in which the auxiliary intermediate member 65 transmits the resistive force of the damper 62 to the lifter gear 35. Thereby, in a configuration where the reliving of impact during insertion of cassette and moderating of lowering speed of the supporting plate 32 during draw-out of the cassette are realized by a single damper 62, the resistive force produced by the damper 62 can be transmitted at an appropriate timing to an appropriate operation portion.

Especially according to the present embodiment, after the sheet feeding cassette 30 is drawn out of the apparatus body, and before the supporting plate 32 reaches the lower position, the link member 63 moves to the projected position, and the damper mechanism 60 will be in a second state exerting a damping function to the lowering movement of the supporting plate 32. Then, when the supporting plate 32 reaches the lower position, the damper mechanism 60 is configured to change to the first state where it exerts a damping function to the insertion of the sheet feeding cassette 30. That is, the present embodiment adopts a configuration in which the state of the damper mechanism 60 is automatically changed after the user draws out the sheet feeding cassette 30 and before the cassette is inserted again, so that the usability is improved.

According further to the present embodiment, the damper mechanism 60 is changed between the first state and the second state depending on whether the piston 62*b* as a first movable member of the damper 62 is fixed or the cylinder 62*a* as a second movable member is fixed. That is, in the first state, the cylinder 62*a* is retained by the auxiliary intermediate member 65 serving as a second abutment portion configured to abut against the second movable member. In this state, the intermediate member 64 serving as a first abutment portion configured to abut against the first movable member presses the piston 62*b*, according to which the resistive force produced by the damper 62 is transmitted to the link member 63. Further, in the second state, the auxiliary intermediate member 65 moves the cylinder 62*a* in a state where the piston 62*b* is retained by the link member 63 and the intermediate member 64, by which the resistive force produced by the damper 62 is transmitted to the supporting plate 32. It is noted that, although the resistive force produced by the damper 62 is transmitted to the link member 63 or the supporting plate 32 using the intermediate member 64 and the auxiliary intermediate member 65 in the present embodiment, the configuration is not limited to that configuration. By changing the shape of the damper 62, a configuration can be adopted where the resistive force produced by the damper 62 is transmitted to the link member 63 or the supporting plate 32 without using the intermediate member 64 and the auxiliary intermediate member 65. In that case, a first end of the damper 62 corresponds to the first transmission portion, and a second end of the damper 62 corresponds to the second transmission portion.

It is preferable that strength of resistive force of the damper 62 or the shape of the cam surface 35*a* and the like are determined such that the time that the supporting plate 32 takes to reach the lower position from the upper limit position of the movable range is shorter than the assumed time from the time when the sheet feeding cassette 30 is drawn out to when the cassette is reinserted. Further, the strength of resistive force applied to the supporting plate 32 can be adjusted by adjusting a radial distance from the pivot shaft of the lifter gear 35 to the cam surface 35*a*. Similarly, the strength of resistive force applied to the link member 63 can be adjusted by adjusting a radial distance from the pivot shaft of the link member 63 to the abutment position of the link member 63 and the piston 62*b*.

Second Embodiment

Next, a configuration of a sheet feeding apparatus according to a second embodiment will be described with reference to FIGS. 5A through 6D. The sheet feeding apparatus according to the second embodiment differs from the first embodiment in that a damper mechanism 90 using a rotation-type damper 70 is provided. Hereafter, the elements that are common to the first embodiment are denoted with the same reference numbers, and descriptions thereof are omitted.

Figure 5C:
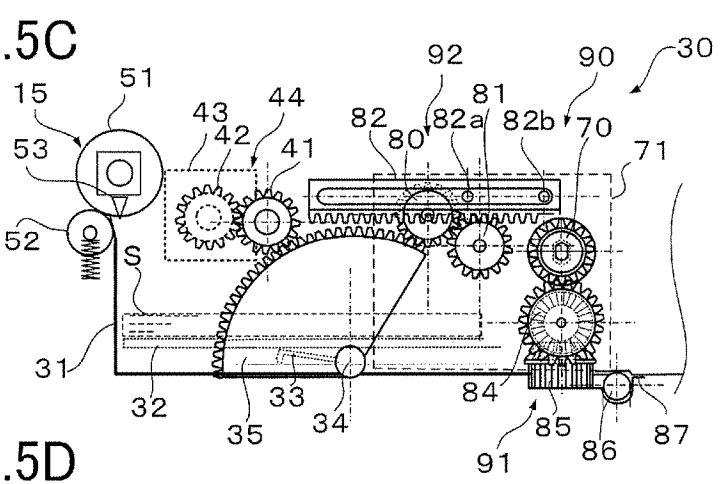
FIG. 5C is a side view illustrating a state after the inserting operation thereof.
Figure 5D:
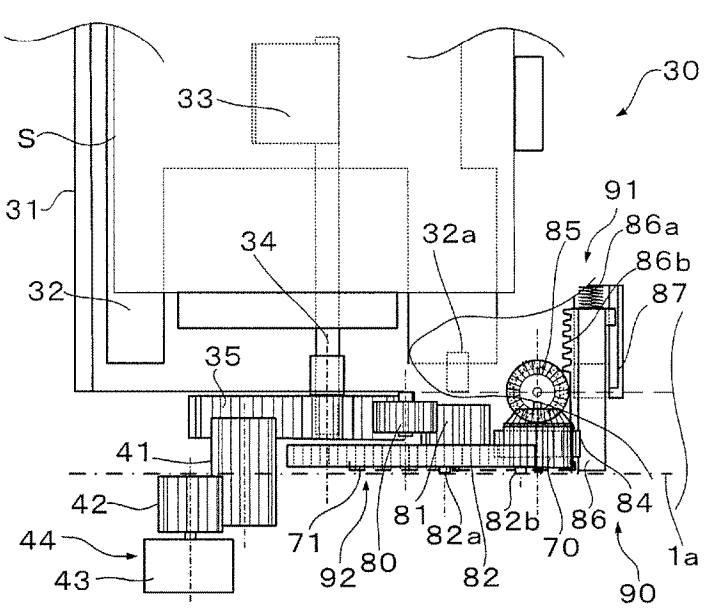
FIG. 5D is an upper view thereof.
Figure 5A:
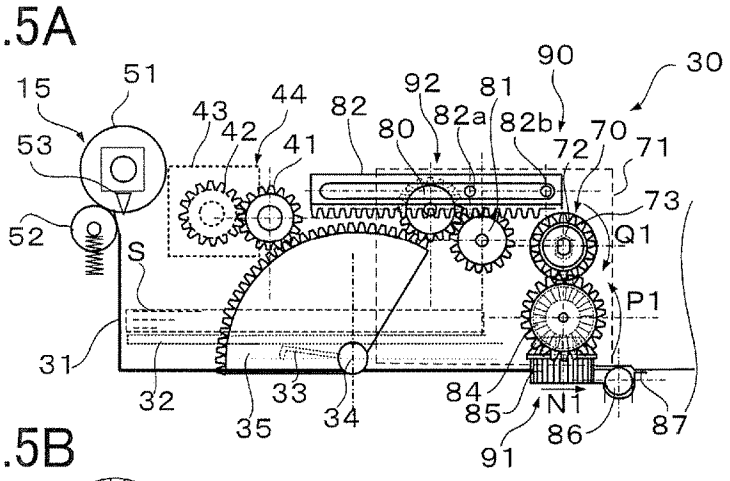
FIG. 5A is a side view illustrating a state in the inserting operation of a sheet feeding cassette according to a second embodiment.
Figure 5B:
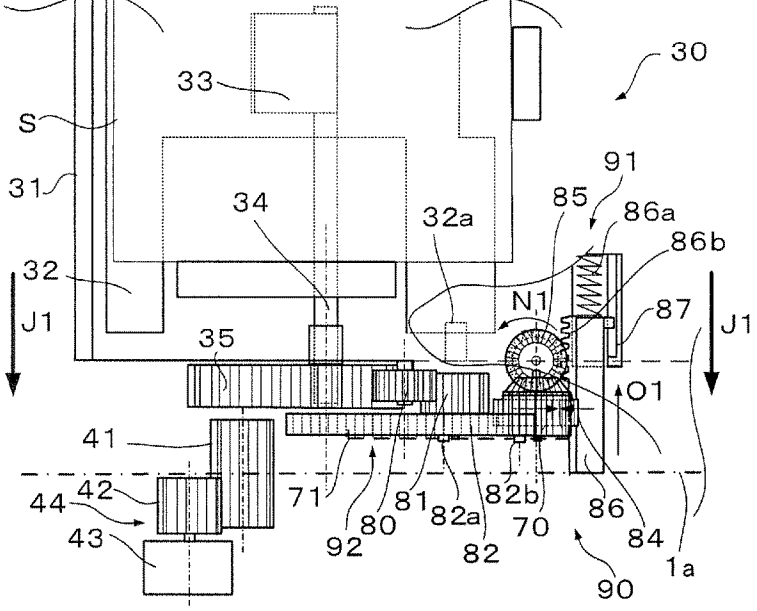
FIG. 5B is an upper view thereof.

As illustrated in FIGS. 5A and 5B, the damper mechanism 90 includes a link-side transmission portion 91 interposed between the damper 70 and a linear motion link 86 serving as another example of a movable portion, and a lifter-side transmission portion 92 interposed between the damper 70 and the supporting plate 32. The link-side transmission portion 91 is a first transmission portion of the present embodiment that transmits resistive force produced by the damper 70 serving as a resistance member to the linear motion link 86, and the lifter-side transmission portion 92 is a second transmission portion of the present embodiment that transmits resistive force produced by the damper 70 to the supporting plate 32 serving as a sheet supporting member.

The damper 70 includes an inner stator 72 fixed to the cassette body 31 and an outer rotor 73 configured to rotate, and offers resistance to rotation of the outer rotor 73 by viscous resistance of oil sealed between the inner stator 72 and the outer rotor 73. The linear motion link 86 is supported slidably by a guide portion 87 fixed to the cassette body 31. The linear motion link 86 is movable to a projected position projected from the cassette body 31 toward the inserting direction J1 and a retracted position retracted upstream in the inserting direction J1 than the projected position. Further, the linear motion link 86 is urged toward the projected position by an urging spring 86*a* serving as an urging member.

The lifter-side transmission portion 92 includes a first idler gear 80 meshed with the lifter gear 35, a second idler gear 81 meshed with the first idler gear, and a first rack gear 82 meshed with both of the second idler gear 81 and the outer rotor 73 of the damper 70. The first rack gear 82 is movable between a position engaged with the damper 70 and a position separated from the damper 70 depending on the rotation angle of the lifter gear 35 by being guided by guide pins 82*a* and 82*b*. The first rack gear 82 is arranged such that it is separated from the damper 70 at least in a state where the supporting plate 32 is at the lower position.

The link-side transmission portion 91 includes a second rack gear 86*b* provided on the linear motion link 86, a third idler gear 85 meshed with the second rack gear 86*b*, and a fourth idler gear 84 meshed with the third idler gear and the outer rotor 73 of the damper 70. The second rack gear 86*b* is arranged to be meshed with the third idler gear 85 if the linear motion link 86 is at the projected position and separated from the third idler gear 85 if the linear motion link 86 is at the retracted position. Further, the third idler gear 85 includes a bevel gear potion, and has a function to convert movement of the linear motion link 86 along the rotation shaft of the damper 70 to a rotary movement in a plane perpendicular to the rotation shaft.

The second rack gear 86*b* and the third idler gear 85 of the link-side transmission portion 91 constitutes a first coupling mechanism that couples and uncouples the damper 70 and the linear motion link 86 depending on a position of the linear motion link 86 serving as a movable portion. The first rack gear 82 of the lifter-side transmission portion 92 and the outer rotor 73 of the damper 70 constitutes a second coupling mechanism that couples and uncouples the damper 70 and the supporting plate 32 depending on a position of the supporting plate 32 serving as a sheet supporting member. The configuration adopting the rack gear (82, 86*b*) is an example of a first or second coupling mechanism, and instead of them, a configuration can be adopted in which the damper 70 and the linear motion link 86 or the supporting plate 32 are coupled and uncoupled using intermittent gears, for example.

An operation of inserting the sheet feeding cassette 30 according to the present embodiment to the apparatus body and drawing the same out of the apparatus body will be described. At first, an inserting operation of the sheet feeding cassette 30 will be described with reference to FIGS. 5A through 5D. FIGS. 5A and 5B illustrate the state in midway of inserting operation of the sheet feeding cassette 30, and FIGS. 5C and 5D illustrate the state after completing the inserting operation. FIGS. 5A and 5C are schematic views illustrating the sheet feeding cassette 30 from a downstream side in the inserting direction J1, and FIGS. 5B and 5D are schematic views illustrating the sheet feeding cassette 30 from above.

As illustrated in FIGS. 5A and 5B, in a state before inserting the sheet feeding cassette 30, the linear motion link 86 is retained at the projected position by urging force of the urging spring 86*a*. Further, the supporting plate 32 is lowered to the lower position by the sheet feeding cassette 30. In this state, the second rack gear 86*b* of the link-side transmission portion 91 is meshed with the third idler gear 85, and the linear motion link 86 and the damper 70 are coupled. Meanwhile, the first rack gear 82 of the lifter-side transmission portion 92 is separated from the damper 70, and the lifter plate 33 and the damper 70 are uncoupled.

If the sheet feeding cassette 30 is moved toward the inserting direction J1 and inserted to the apparatus body, the lifter gear 35 and the idler gear 41 are meshed and the lifter plate 33 is coupled to the lifting motor 43. In parallel therewith, the linear motion link 86 at the projected position is abutted against the side plate 1*a* fixed to the apparatus body, pressed by the side plate 1*a* and slid in the direction of arrow O1.

Then, interlocked with the movement of the linear motion link 86, the third idler gear 85, the fourth idler gear 84 and the outer rotor of the damper 70 are respectively rotated in the direction of arrows N1, P1 and Q1, and resistive force produced by the damper 70 is transmitted to the linear motion link 86. Then, since the outer rotor of the damper 70 is rotated against viscous resistance of oil sealed between the inner stator, a portion of the kinetic energy of the sheet feeding cassette is consumed by doing the work of rotating the outer rotor of the damper 70. That is, the insertion speed of the sheet feeding cassette 30 is reduced by the damper 70 offering resistance to the relative movement of the cassette body 31 and the linear motion link 86 compared to the case where the damper mechanism 90 is not provided.

As illustrated in FIGS. 5C and 5D, in a state where the sheet feeding cassette 30 is inserted to the apparatus body, the linear motion link 86 is pressed by the side plate 1*a* of the apparatus body and retained at the retracted position. At this time, the second rack gear 86*b* of the linear motion link 86 is separated from the third idler gear 85, and the coupling of the linear motion link 86 and the damper 70 is released.

Figure 6C:
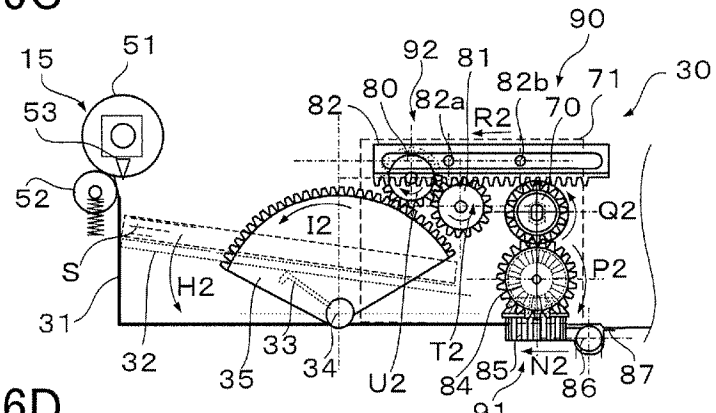
FIG. 6C is a side view illustrating a state in the draw-out operation thereof.
Figure 6D:
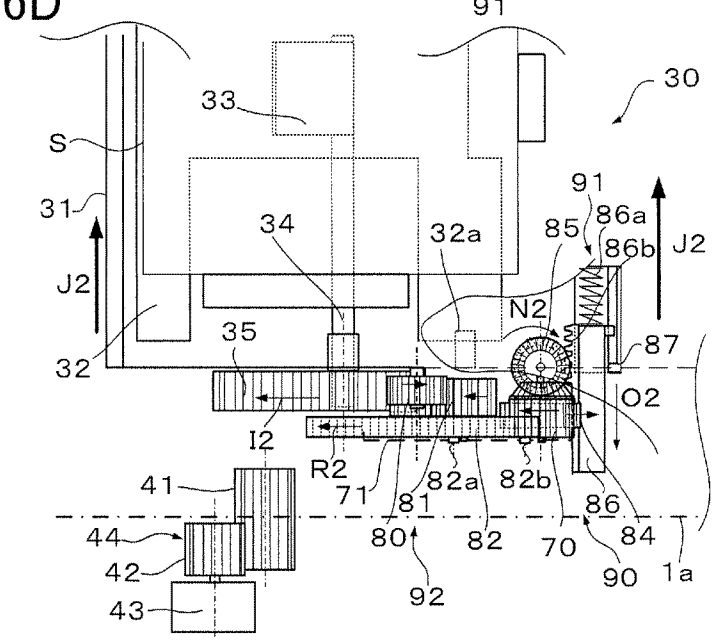
FIG. 6D is an upper view thereof.
Figure 6A:
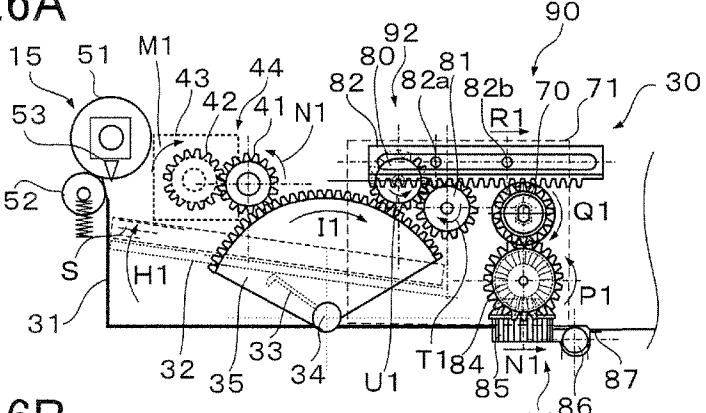
FIG. 6A is a side view illustrating the sheet feeding cassette before being drawn out of the apparatus body according to the second embodiment.
Figure 6B:
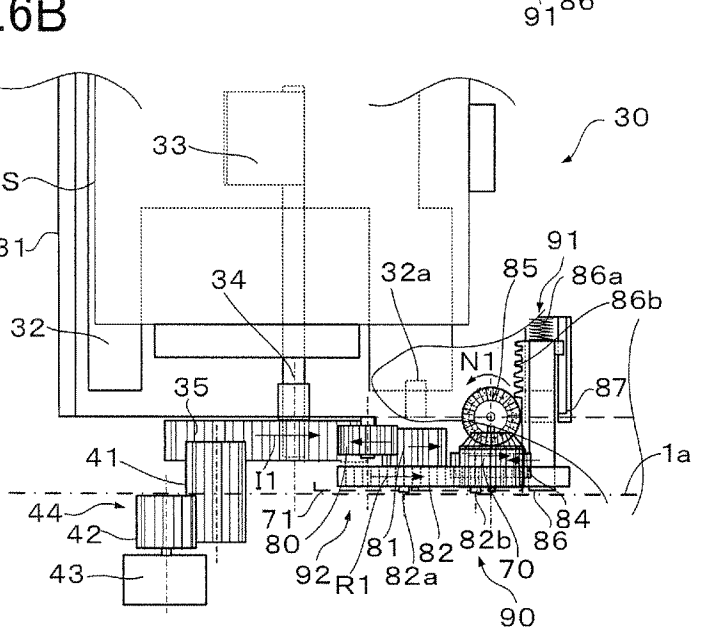
FIG. 6B is an upper view thereof.

Next, the operation of drawing the sheet feeding cassette 30 out of the apparatus body will be described with reference to FIGS. 6A through 6D. FIGS. 6A and 6B illustrate the state before the sheet feeding cassette 30 is drawn out, and FIGS. 6C and 6D illustrate the state in midway of the draw-out operation of the sheet feeding cassette 30. FIGS. 6A and 6C are schematic views illustrating the sheet feeding cassette 30 from the downstream side in the inserting direction J1, and FIGS. 6B and 6D are schematic views illustrating the sheet feeding cassette 30 from above.

As illustrated in FIGS. 6A and 6B, the lifting motor 43 is started to be driven after the sheet feeding cassette 30 is inserted to the apparatus body. Then, the output gear 42, the idler gear 41 and the lifter gear 35 are respectively rotated in the directions of arrows M1, N1 and I1, and thereby, the supporting plate 32 is lifted toward the direction of arrow H1. The lifting motor 43 is stopped if the upper surface of the sheet S is detected by the supported surface detection sensor 53, and thereafter, feeding of the sheet S is started by starting the feed roller 51.

Now, the first idler gear 80 and the second idler gear 81 are rotated in the directions of arrows U1 and T1 along with the operation of the lifter gear 35 rotating in the direction of arrow I1, and the first rack gear 82 moves in the direction of arrow R1, that is, toward the direction approximating the damper 70. When the first rack gear 82 and the outer rotor of the damper 70 are meshed, the lifter plate 33 and the damper 70 are coupled through the lifter-side transmission portion 92. Meanwhile, the linear motion link 86 and the damper 70 maintain an uncoupled state, and the linear motion link 86 will not interfere with the meshing operation of the first rack gear 82 and the damper 70 and the lifting operation of the supporting plate 32.

As illustrated in FIGS. 6C and 6D, if the sheet feeding cassette 30 is drawn out of the apparatus body along the draw-out direction J2, the lifter gear 35 is separated from the idler gear 41, and the drive-coupling of the lifter plate 33 and the lifting motor 43 is released. Then, the supporting plate 32 starts lowering in the direction of arrow H2 by its own weight and the weight of the sheet S. In this state, the lifter gear 35, the first idler gear 80 and the second idler gear 81 are respectively rotated in the directions of arrows 12, U2 and T2 along with the lowering movement of the supporting plate 32, and the first rack gear 82 slides in the direction of arrow R2. Along with the rotation of the damper 70 in the direction of arrow Q2, the third idler gear 85 and the fourth idler gear 84 are respectively rotated in the directions of arrows N2 and P2, and the linear motion link 86 is moved toward the direction of arrow O2.

In this state, since the lifter plate 33 is coupled to the damper 70 through the lifter-side transmission portion 92, the outer rotor of the damper 70 is rotated in the direction of arrow Q2 along with the lowering movement of the supporting plate 32. Therefore, a portion of kinetic energy of the supporting plate 32 in the downward direction is consumed by doing the work of rotating the outer rotor of the damper 70, and the lowering speed of the supporting plate 32 is reduced. That is, the lowering speed of the supporting plate 32 is reduced by the damper 70 offering resistance to the lowering movement of the supporting plate 32, compared to the case where the damper mechanism 90 is not provided.

If the supporting plate 32 is lowered to the lower position, the coupling of the first rack gear 82 and the damper 70 is released. Drive transmission ratio of the lifter-side transmission portion 92 should preferably be set so that the supporting plate 32 reaches the lower position faster (for example, less than one second) than the assumed time from when the user draws out the sheet feeding cassette 30 to the reinsertion of the cassette. In this state, depending on the amount of rotation of the third idler gear 85 to when the first rack gear 82 is separated from the damper 70, the linear motion link 86 may move toward the inserting direction J1 past the projected position. However, in a state where the first rack gear 82 and the damper 70 are uncoupled, the linear motion link 86 is moved to the projected portion by the urging force of the urging spring 86*a*, such that the second rack gear 86*b* and the third idler gear 85 are returned to the meshed state. If the sheet feeding cassette 30 is reinserted to the apparatus body in this state, as illustrated with reference to FIGS. 5A through 5D, the inserting operation of the sheet feeding cassette 30 is damped by the resistive force produced by the damper 70.

By installing a one-way clutch to the damper 70, for example, a configuration can be adopted where the damper 70 rotates idly in the direction of arrow P1 and generates resistive force only in the opposite direction, that is, the direction of rotation corresponding to the lowering movement of the supporting plate 32. In that case, by adopting a configuration of directly engaging the first idler gear 80 with the first rack gear 82, for example, the rotation direction of the damper 70 when the supporting plate 32 is lowered and the rotation direction of the damper 70 when the linear motion link 86 is pressed in from the projected position to the retracted position should correspond. Alternatively, the lifting speed of the supporting plate 32 should be set small such that the resistive force from the damper 70 falls within a sufficiently small range.

As described, the damper mechanism 90 according to the present embodiment uses the rotation-type damper 70 serving as a common resistance member to realize both relieving of impact during insertion of cassette and moderating of lowering speed of the supporting plate 32 during draw-out of cassette. Therefore, a sheet feeding apparatus having high usability and capable of overcoming inconveniences such as sheet displacement can be achieved both during draw-out of the sheet feeding cassette 30 from the apparatus body and during insertion thereof to the apparatus body. At the same time, costs can be saved compared to the configuration where a plurality of resistance members are arranged to realize the respective damping function, as according to the above-described comparative examples.

Further, the damper mechanism 90 according to the present embodiment adopts a configuration in which the state of the damper mechanism 90 is changed depending on the position of the supporting plate 32 in a state where the sheet feeding cassette 30 is drawn out of the apparatus body. If the supporting plate 32 is at the lower position (FIGS. 5A and 5B), the linear motion link 86 and the damper are coupled by the link-side transmission portion 91, while the coupling of the lifter plate 33 and the damper 70 by the lifter-side transmission portion 92 is released. In this case, the damper mechanism 90 will be in a first state where resistive force produced by the resistance member is transmittable by the first transmission portion to the movable portion. Further, if the supporting plate 32 is at the upper position (FIGS. 6C and 6D), the lifter plate 33 and the damper 70 are coupled by the lifter-side transmission portion 92, while the coupling of the linear motion link 86 and the damper 70 by the link-side transmission portion 91 is released. In this case, the damper mechanism 90 will be in a second state where resistive force produced by the resistance member is transmitted by the second transmission portion to the sheet supporting member. Thus, in a configuration where relieving of impact during insertion of the cassette and moderating of lowering speed of the supporting plate 32 during draw-out of the cassette are realized by a single the damper 70, resistive force produced by the damper 70 can be transmitted at appropriate timings to appropriate work areas.

According to the present embodiment, a configuration is adopted where the damper mechanism 90 enters a second state exerting a damping function to the lowering movement of the supporting plate 32 simultaneously as the sheet feeding cassette 30 is drawn out of the apparatus body. According to this configuration, the damper mechanism 90 is switched to a first state exerting a damping function with respect to the insertion of the sheet feeding cassette 30 when the supporting plate 32 reaches the lower position. Since the state of the damper mechanism 90 is switched automatically after the user draws out the sheet feeding cassette 30 and before the cassette is reinserted, the usability can be improved.

Third Embodiment

Next, a configuration of a sheet feeding apparatus according to a third embodiment will be described with reference to FIGS. 7A through 8D. The sheet feeding apparatus according to the present embodiment differs from the second embodiment in that a damper mechanism 120 using a linear-motion damper 89 is provided. Hereafter, elements common to the second embodiment are denoted with the same reference numbers, and descriptions thereof are omitted.

Figure 7A:
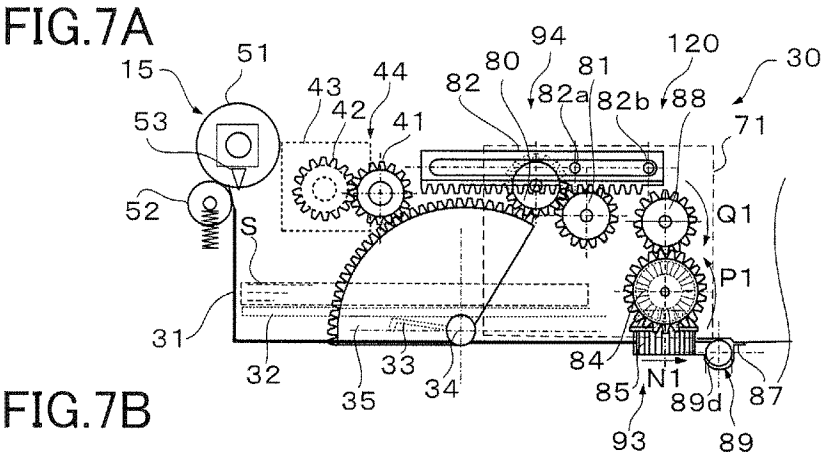
FIG. 7A is a side view illustrating a state in an inserting operation of a sheet feeding cassette according to a third embodiment.
Figure 7B:
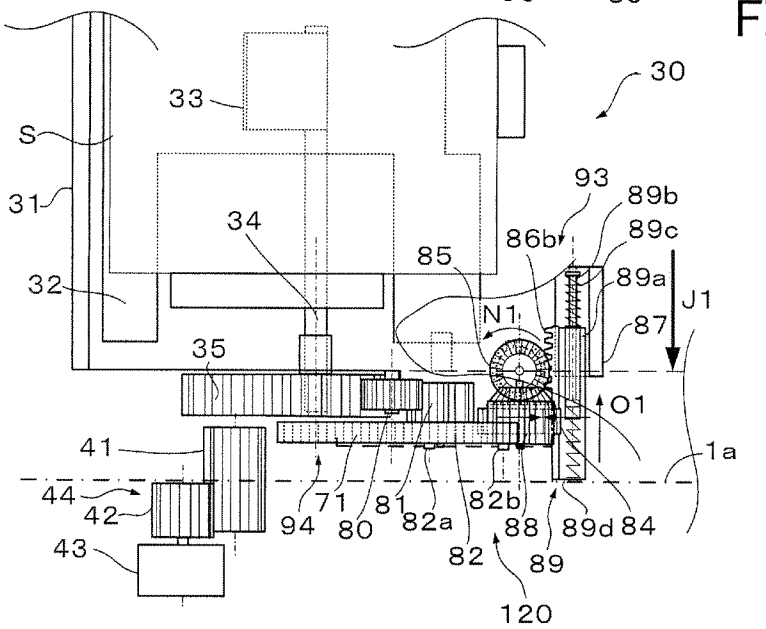
FIG. 7B is an upper view thereof.

As illustrated in FIGS. 7A and 7B, the damper mechanism 120 includes a linear motion-type damper 89, a damper-side transmission portion 93 and a lifter-side transmission portion 94. The damper 89 has oil sealed therein, and includes a cylinder 89*a* slidable along the inserting direction J1 by the guide portion 87, a piston 89*b* fixed to the cassette body, and a return spring 89*c* urging the cylinder 89*a* toward the inserting direction J1.

The configurations of the damper-side transmission portion 93 and the lifter-side transmission portion 94 are common to the link-side transmission portion 91 and the lifter-side transmission portion 92 according to the second embodiment. That is, the lifter-side transmission portion 94 includes the first idler gear 80 meshed with the lifter gear 35, the second idler gear 81 meshed with the first idler gear and the first rack gear 82 meshed with the first idler gear. The damper-side transmission portion 93 includes the second rack gear 86*b* provided on the damper 89, the third idler gear 85 meshed with the second rack gear 86*b* and the fourth idler gear 84 meshed with the third idler gear 85.

The present embodiment adopts a configuration where the cylinder 89*a* of the damper 89 serving as a resistance member is abutted directly against the side plate 1*a* of the apparatus body. A bottom surface 89*d* of the cylinder 89*a* is another example of a movable portion relatively movable with respect to the sheet feeding cassette 30. The cylinder 89*a* is urged toward a projected position in which the bottom surface 89*d* is projected from the cassette body 31 downstream in the inserting direction J1 by urging force of the return spring 89*c* serving as an urging member. Further, the cylinder 89*a* moves to the retracted position retracted upstream in the inserting direction J1 compared to the projected position by having the bottom surface 89*d* pressed by the side plate 1*a* of the apparatus body 100.

The damper-side transmission portion 93 and the lifter-side transmission portion 94 are coupled by a fifth idler gear 88 arranged instead of the damper 70 of the second embodiment. The first rack gear 82 of the lifter-side transmission portion 94 is movable between a position meshed with the fifth idler gear 88 and a position separated from the fifth idler gear 88. Meanwhile, the fourth idler gear 84 of the damper-side transmission portion 93 is constantly meshed with the fifth idler gear 88. Therefore, the damper-side transmission portion 93 and the lifter-side transmission portion 94 are switched between a coupled state and an uncoupled state by the first rack gear 82 being engaged with or separated from the fifth idler gear 88 according to the rotation angle of the lifter gear 35. The first rack gear 82 and the fifth idler gear constitute a coupling mechanism that couples and uncouples the supporting plate 32 and the damper 89 according to the position of the supporting plate 32 serving as a sheet supporting member.

Figure 7C:
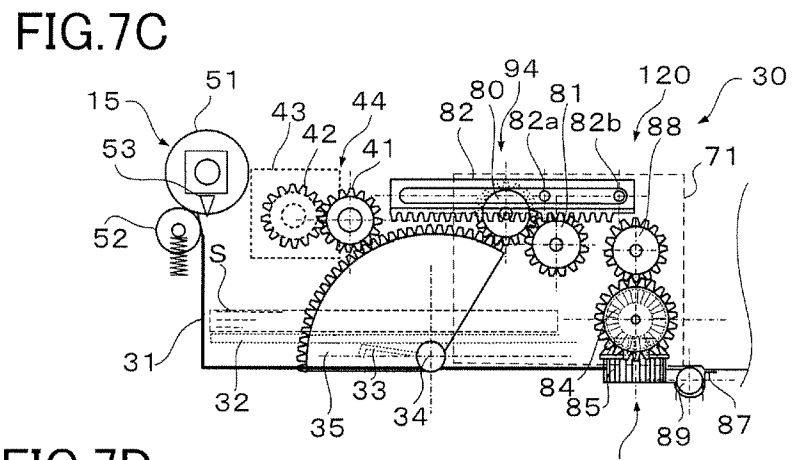
FIG. 7C is a side view illustrating a state after inserting operation thereof.
Figure 7D:
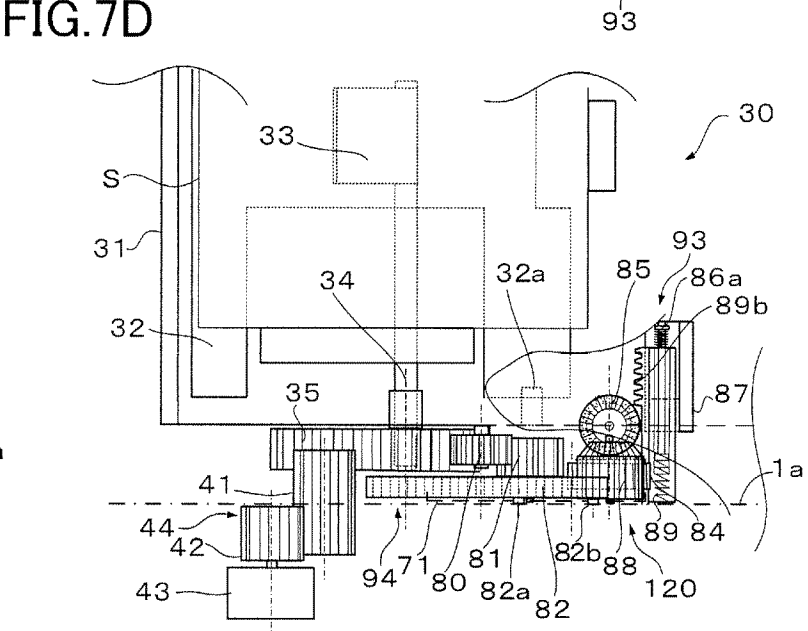
FIG. 7D is an upper view thereof.

The operation of inserting the sheet feeding cassette 30 according to the present embodiment to the apparatus body and drawing out the same from the apparatus body will be described. At first, the inserting operation of the sheet feeding cassette 30 will be described with reference to FIGS. 7A through 7D. FIGS. 7A and 7B illustrate the state in midway of inserting operation of the sheet feeding cassette 30, and FIGS. 7C and 7D illustrate the state after completion of the inserting operation. Further, FIGS. 7A and 7C are schematic views illustrating the sheet feeding cassette 30 from a downstream side in the inserting direction J1, and FIGS. 7B and 7D are schematic vies illustrating the sheet feeding cassette 30 from above.

As illustrated in FIGS. 7A and 7B, in a state before the sheet feeding cassette 30 is inserted, the damper 89 is retained at the projected position by urging force of the return spring 89*c*. Further, the supporting plate 32 is lowered to the lower position by the sheet feeding cassette 30. In this state, the first rack gear 82 of the lifter-side transmission portion 94 is separated from the fifth idler gear 88, and coupling of the lifter plate 33 and the damper 89 is released.

If the sheet feeding cassette 30 is moved toward the inserting direction J1 and inserted to the apparatus body, the lifter gear 35 and the idler gear 41 are meshed and the lifter plate 33 is drive-coupled to the lifting motor 43. In parallel therewith, the bottom surface 89*d* of the cylinder 89*a* in the damper 89 at the projected position is abutted against the side plate 1*a* fixed to the apparatus body, pressed by the side plate 1*a* and slid in the direction of arrow 01.

Then, along with the movement of the cassette body 31, the piston 89*b* is pushed in toward the inserting direction J1 with respect to the cylinder 89*a* against viscous resistance of the oil. Thereby, a portion of kinetic energy of the sheet feeding cassette 30 is consumed by doing the work of contracting the damper 89. That is, insertion speed of the sheet feeding cassette 30 is reduced by the damper 89 offering resistance to the relative movement of the cassette body 31 and the bottom surface 89*d* of the cylinder 89*a*, compared to the case where the damper mechanism 120 is not provided. Interlocked with the movement of the cylinder 89*a*, rotational force toward directions of arrows N1, P1 and Q1 are respectively transmitted to the third idler gear 85, the fourth idler gear 84 and the fifth idler gear 88. In this state, the first rack gear 82 is separated from the fifth idler gear 88, such that the gears are rotated idly.

As illustrated in FIGS. 7C and 7D, in a state where the sheet feeding cassette 30 is inserted to the apparatus body, the damper 89 is pressed by the side plate 1*a* of the apparatus body and retained at the retracted position. In this state, the second rack gear 86*b* is separated from the third idler gear 85, and the coupling of the damper 89 and the fifth idler gear 88 is released.

Figure 8C:
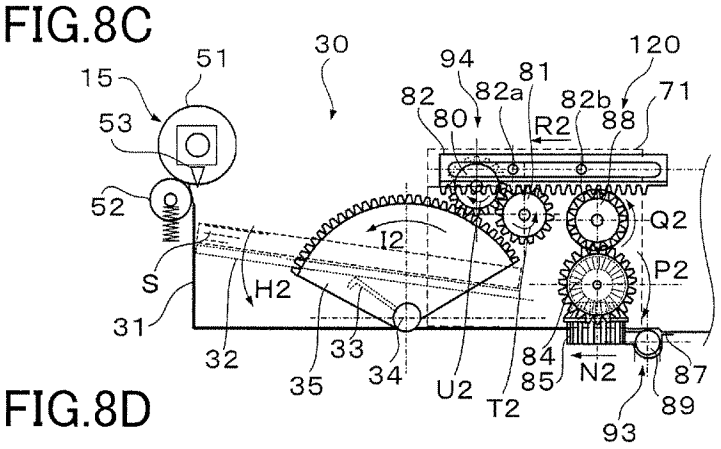
FIG. 8C is a side view illustrating a state in a draw-out operation thereof.
Figure 8D:
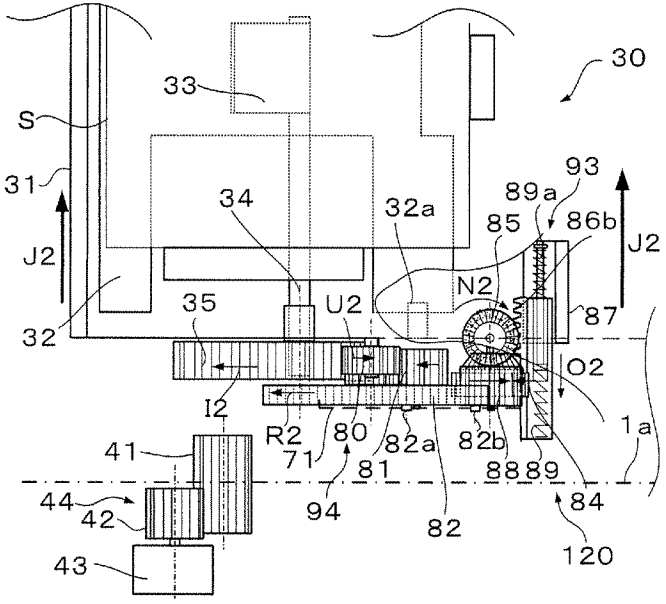
FIG. 8D is an upper view thereof.
Figure 8A:
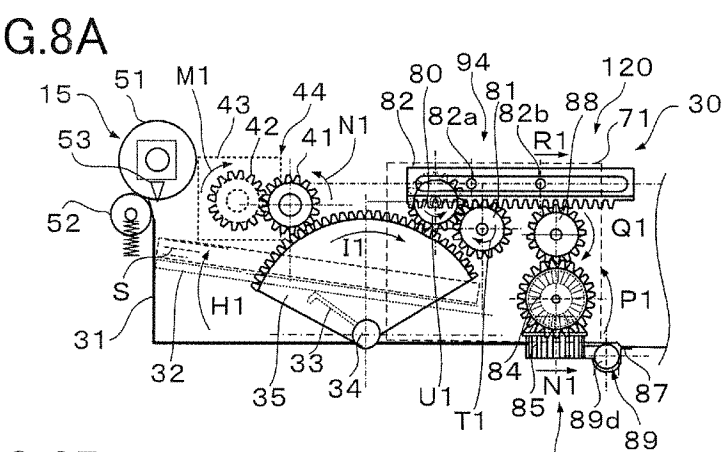
FIG. 8A is a side view illustrating a state before drawing out a sheet feeding cassette from an apparatus body according to a fourth embodiment.
Figure 8B:
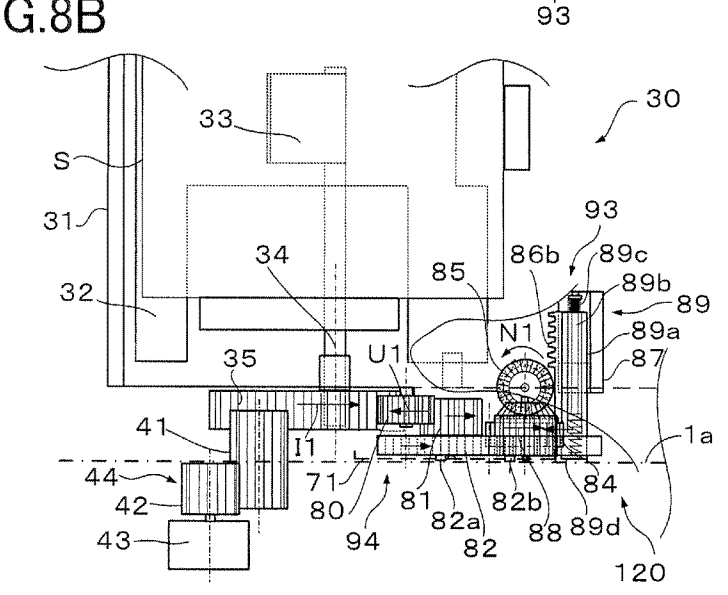
FIG. 8B is an upper view thereof.

Next, the operation of drawing the sheet feeding cassette 30 out of the apparatus body will be described with reference to FIGS. 8A through 8D. FIGS. 8A and 8B illustrate the state before the sheet feeding cassette 30 is dawn out, and FIGS. 8C and 8D illustrate the state in midway of draw-out operation of the sheet feeding cassette 30. FIGS. 8A and 8C are schematic views illustrating the sheet feeding cassette 30 from the downstream side in the inserting direction J1, and FIGS. 8B and 8D are schematic views illustrating the sheet feeding cassette 30 from above.

As illustrated in FIGS. 8A and 8B, the lifting motor 43 is started to be driven after the sheet feeding cassette 30 is inserted to the apparatus body. Then, the output gear 42, the idler gear 41 and the lifter gear 35 are respectively rotated in the directions of arrows M1, N1 and I1, and the supporting plate 32 is lifted toward the direction of arrow H1. The lifting motor 43 is stopped if an upper surface of a sheet S is detected by the supported surface detection sensor 53, and thereafter, feeding of the sheet S is started by the starting of drive of the feed roller 51.

Then, along with the operation in which the lifter gear 35 rotates in the direction of arrow I1, the first idler gear 80 and the second idler gear 81 are rotated in directions of arrows U1 and T1, and the first rack gear 82 moves in the direction of arrow R1, that is, direction approximating the fifth idler gear 88. Then, the first rack gear 82 is meshed with the fifth idler gear 88. Meanwhile, a state is maintained where the damper 89 and the fifth idler gear 88 are uncoupled, such that the damper 89 will not interfere with the operation of the first rack gear 82 meshing with the fifth idler gear 88 and the lifting operation of the supporting plate 32.

As illustrated in FIGS. 8C and 8D, if the sheet feeding cassette 30 drawn out of the apparatus body along the draw-out direction J2, the lifter gear 35 is separated from the idler gear 41 and drive-coupling of the lifter plate 33 and the lifting motor 43 is released. Then, the supporting plate 32 starts to be lowered in the direction of arrow H2 by its own weight and the weight of the sheets S. Further, along with the draw-out operation of the sheet feeding cassette 30, the cylinder 89*a* of the damper 89 is moved toward the projected position by urging force of the return spring 89*c*. Thereby, before the supporting plate 32 reaches the lower position, the second rack gear 86*b* provided on the cylinder 89*a* is meshed with the third idler gear 85.

Thereby, the lifter plate 33 is coupled through the lifter-side transmission portion 94, the fifth idler gear 88 and the damper-side transmission portion 93 to the damper 89. Along with the lowering movement of the supporting plate 32, the lifter gear 35, the first idler gear 80 and the second idler gear 81 are respectively rotated in the directions of arrows 12, U2 and T2, and the first rack gear 82 slides in the direction of arrow R2. Along therewith, the fifth idler gear 88, the fourth idler gear 84 and the third idler gear 85 are respectively rotated in the directions of arrows Q2, P2 and N2, and the second rack gear 86*b* slides in the direction of arrow 02.

As a result, along with the lowering movement of the supporting plate 32, the cylinder 89*a* of the damper 89 slides in the direction of arrow O2, with the position of the piston 89*b* set as reference. Therefore, a portion of the kinetic energy in the downward direction of the supporting plate 32 is consumed by doing the work of expanding the damper 89 and lowering speed of the supporting plate 32 is reduced. Thereby, lowering speed of the supporting plate 32 is reduced by the damper 89 offering resistance to lowering movement of the supporting plate 32, compared to the case where the damper mechanism 120 is not provided.

If the supporting plate 32 is lowered to the lower position, coupling of the first rack gear 82 and the fifth idler gear 88 is released. In this state, if the sheet feeding cassette 30 is reinserted to the apparatus body, as described with reference to FIGS. 7A through 7D, inserting operation of the sheet feeding cassette 30 is damped by resistive force produced by the damper 89.

As described, the damper mechanism 120 according to the present embodiment realizes relieving of impact during insertion of cassette and moderating of lowering speed of the supporting plate 32 during draw-out of cassette using the linear motion-type damper 89 serving as a common resistance member. Therefore, a sheet feeding apparatus having high usability and capable of overcoming inconveniences such as sheet displacement can be achieved both during draw-out of the sheet feeding cassette 30 from the apparatus body and during insertion thereof to the apparatus body. Costs can be cut down compared to the configuration where a plurality of resistance members are arranged to realize the respective damping functions, as in the above-described comparative examples.

Further, the damper mechanism 120 according to the present embodiment adopts a configuration in which the state of the damper mechanism 120 is switched depending on the position of the supporting plate 32 in a state where the sheet feeding cassette 30 is drawn out of the apparatus body. That is, in a state where the supporting plate 32 is at the lower position (FIGS. 7A and 7B), coupling of the lifter plate 33 and the fifth idler gear 88 by the lifter-side transmission portion 94 is released. That is, in this case, the damper mechanism 120 is in a first state where the resistive force produced by the damper 89 acts on the apparatus body through the bottom surface 89*d* of the cylinder 89*a*. Further, if the supporting plate 32 is at the upper position (FIGS. 8C and 8D), the lifter plate 33 and the fifth idler gear 88 are coupled by the lifter-side transmission portion 94. That is, in this case, the damper mechanism 120 is in a second state where the resistive force produced by the damper 89 is transmitted through the damper-side transmission portion 93, the fifth idler gear and the lifter-side transmission portion 94 to the supporting plate 32.

As described above, according to the present embodiment, a coupling mechanism (82, 88) capable of coupling and uncoupling the sheet supporting member and the resistance member depending the position of the sheet supporting member is provided. Thereby, in a configuration where relieving of impact during insertion of cassette and moderating of lowering speed of the supporting plate 32 during draw-out of cassette are realized by a single damper 89, the resistive force produced by the damper 89 can be transmitted to an appropriate work area at an appropriate timing.

According to the present embodiment, after the sheet feeding cassette 30 is drawn out of the apparatus body, the cylinder 89*a* is moved toward the projected position, by which the damper mechanism 120 enters a second state exerting a damping function to the lowering movement of the supporting plate 32. If the supporting plate 32 reaches the lower position, the damper mechanism 90 is designed to be switched to the first state exerting damping function to the insertion of the sheet feeding cassette 30. That is, the present embodiment adopts a configuration where the damper mechanism 90 is switched automatically after the user draws out the sheet feeding cassette 30 and before the cassette is reinserted, such that the usability can be enhanced.

Other Embodiments

The first to third embodiments described above adopts a configuration where the sheet feeding apparatus is configured by the apparatus body of the image forming apparatus 1 and the sheet feeding cassette 30 attached to the apparatus body, but a configuration can also be adopted where the sheet feeding apparatus is provided independently from the main body of the image forming apparatus 1 having the printing function. For example, the present technique can be applied to an option feeder that can be additionally installed as necessary to the image forming apparatus 1.

The linear-motion damper and the rotary damper according to the first to third embodiments are examples of the resistance member, and resistance members adopting other working principles can also be used. For example, an air damper that uses air instead of oil as viscous fluid, a damper that attenuates kinetic energy by friction, or a damper that absorbs kinetic energy as elastic energy using an elastic body such as a spring can also be adopted.

The lifter plate and the lifter gear are examples of a lift portion lifting the sheet supporting member, and for example, a winding shaft that winds up a wire coupled to the sheet supporting member can also be used as the lift portion. Further, in the first to third embodiments, the resistive force produced by the damper is described as being transmitted to the supporting plate through a lifter gear, but a configuration can also be adopted where the resistive force produced by the resistance member is transmitted to the sheet supporting member without intervening the lift portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-084867, filed on Apr. 21, 2017 which is hereby incorporated by reference wherein in its entirety.

What is claimed is:

1. A sheet feeding apparatus comprising:

a body;

a sheet storage portion configured to store a sheet and inserted to the body;

a sheet supporting member configured to support the sheet and liftable with respect to the sheet storage portion;

a lift portion configured to lift the sheet supporting member with respect to the sheet storage portion; and a damper mechanism comprising:

a movable portion supported by the sheet storage portion and configured to be moved with respect to the sheet storage portion by abutting against the body in a case where the sheet storage portion is inserted to the body;

a resistance member configured to produce a resistive force;

a first transmission portion interposed between the resistance member and the movable portion, the first transmission portion configured to actuate the resistance member to produce the resistive force and transmit the resistive force to the movable portion along with movement of the movable portion, so that an insertion speed of the sheet storage portion is reduced in a case where the sheet storage portion is inserted to the body; and a second transmission portion interposed between the resistance member and the sheet supporting member, the second transmission portion configured to actuate the resistance member to produce the resistive force and transmit resistive force to the sheet supporting member along with lowering movement of the sheet supporting member, so that a lowering speed of the sheet supporting member is reduced in a case where the sheet storage portion with the sheet supporting member having been lifted by the lift portion is drawn out of the body.

2. The sheet feeding apparatus according to claim 1, wherein the sheet supporting member is movable between a lower position where the sheet supporting member is restricted from lowering by the sheet storage portion and an upper position positioned above the lower position, and is lowered toward the lower position in a case where the sheet storage portion with the sheet supporting member at the upper position is drawn out of the body, wherein the first transmission portion is configured to transmit the resistive force produced by the resistance member to the movable portion in a case where the sheet supporting member is at the lower position, and wherein the second transmission portion is configured to transmit the resistive force produced by the resistance member to the sheet supporting member in a case where the sheet supporting member moves from the upper position toward the lower position.

3. The sheet feeding apparatus according to claim 2, further comprising an urging member configured to urge the movable portion in a movable direction of the movable portion, wherein the movable portion is movable to a first position and a second position, is positioned at the first position by an urging force of the urging member, and is positioned at a second position by being pressed by the body in a state where the sheet storage portion is inserted to the body, wherein in a case where the sheet supporting member is at the lower position, the damper mechanism is brought to a first state in which the first transmission portion actuates the resistance member to produce the resistive force if the movable portion is at the first position and the sheet supporting member is at the lower position, and is brought to a second state in which the second transmission portion actuates the resistance member to produce the resistive force if the movable portion is at the first position and the sheet supporting member is at the upper position, and wherein the urging member is configured to move the movable portion from the second position to the first position before the sheet supporting member reaches the lower position in a case where the sheet storage portion with the sheet supporting member at the upper position is drawn out of the body.

4. The sheet feeding apparatus according to claim 1, wherein the resistance member comprises a first movable member and a second movable member movable with respect to the first movable member, and is configured to produce a resistive force that resists relative movement of the first and second movable members, wherein the first transmission portion comprises a first abutment portion configured to move along with movement of the movable portion and to abut against the first movable member, wherein the second transmission portion comprises a second abutment portion configured to move along with movement of the sheet supporting member and to abut against the second movable member, and wherein the damper mechanism is configured to apply the resistive force produced by the resistance member to the movable portion such that the first abutment portion moves the first movable member in a state where the second movable member is restricted from moving by the second abutment portion, and is configured to apply the resistive force produced by the resistance member to the sheet supporting member such that the second abutment portion moves the second movable member in a state where the first movable member is restricted from moving by the first abutment portion.

5. The sheet feeding apparatus according to claim 4, wherein the resistance member is configured to lengthen and shorten by the first and second movable members performing linear relative motion in an operation direction, wherein the first abutment portion abuts against the resistance member from one side in the operation direction, and wherein the second abutment portion abuts against the resistance member from the other side in the operation direction.

6. The sheet feeding apparatus according to claim 4, wherein the lift portion comprises a lifting gear configured to lift and lower the sheet supporting member, and wherein the second transmission portion comprises a cam surface provided on the lifting gear, the cam surface being configured to move the second movable member along with rotation of the lifting gear while the sheet supporting member is lowered.

7. The sheet feeding apparatus according to claim 1, wherein the resistance member is a dashpot comprising a cylinder in which fluid is sealed and a piston inserted to the cylinder, each of the cylinder and the piston being movable in a sliding direction of the piston, and wherein the damper mechanism comprises a first abutment portion engaged with the movable portion and configured to press one of the cylinder and the piston in a case where the sheet storage portion is inserted to the body, and a second abutment portion engaged with the sheet supporting member and configured to press the other one of the cylinder and the piston along with lowering movement of the sheet supporting member.

8. The sheet feeding apparatus according to claim 7, wherein the sheet supporting member is configured to move between a lower position where the sheet supporting member is restricted from lowering by the sheet storage portion and an upper position positioned above the lower position, wherein the first abutment portion is configured to press the one of the cylinder and the piston with the other of the cylinder and the piston being retained by the second abutment portion in a case where the sheet storage portion is inserted to the body, and wherein the second abutment portion is configured to press the other of the cylinder and the piston with the one of the cylinder and the piston being retained by the first abutment portion in a case where the sheet storage portion with the sheet supporting member at the upper position is drawn out of the body.

9. The sheet feeding apparatus according to claim 1, wherein the sheet supporting member is movable between a lower position where the sheet supporting member is restricted from lowering by the sheet storage portion and an upper position positioned above the lower position, and wherein the damper mechanism comprises a first coupling mechanism configured to couple the movable portion and the resistance member in a state where the sheet storage portion is drawn out of the body, and uncouple the movable portion and the resistance member in a state where the sheet storage portion is inserted to the body, and a second coupling mechanism configured to couple the sheet supporting member and the resistance member in a state where the sheet supporting member is at the upper position, and uncouple the sheet supporting member and the resistance member in a state where the sheet supporting member is at the lower position.

10. The sheet feeding apparatus according to claim 9, wherein the resistance member comprises an inner stator fixed to the sheet storage portion and a rotatable outer rotor arranged outside of the inner stator, and is configured to produce resistive force resisting rotation of the outer rotor, wherein the first coupling mechanism is configured to couple and uncouple the outer rotor and the movable portion, and wherein the second coupling mechanism is configured to couple and uncouple the outer rotor and the sheet supporting member.

11. The sheet feeding apparatus according to claim 1, wherein the resistance member is supported movably by the sheet storage portion, wherein the movable portion is a part of the resistance member, wherein the sheet supporting member is configured to move between a lower position where the sheet supporting member is restricted from lowering by the sheet storage portion and an upper position positioned above the lower position, and wherein the damper mechanism comprises a coupling mechanism configured to couple the sheet supporting member and the resistance member in a state where the sheet supporting member is positioned at the upper position and uncouple the sheet supporting member and the resistance member in a state where the sheet supporting member is positioned at the lower position.

12. The sheet feeding apparatus according to claim 1, further comprising:

a driving source disposed in the body and configured to drive the lift portion; and a drive transmission portion configured to couple the driving source and the lift portion in a state where the sheet storage portion is inserted to the body and uncouple the driving source and the lift portion in a state where the sheet storage portion is drawn out of the body.

13. The sheet feeding apparatus according to claim 12, wherein the drive transmission portion comprises a driving gear supported by the body and rotated by a driving force from the driving source and a driven gear supported by the sheet storage portion and configured to be driven to move the lift portion by the driving gear, and wherein the driven gear is separated from the driving gear in a case where the sheet storage portion is drawn out of the body, and is meshed with the driving gear in a case where the sheet storage portion is inserted to the body.

14. The sheet feeding apparatus according to claim 1, wherein the resistance member is configured to produce the resistive force by viscous resistance of fluid sealed therein.

15. An image forming apparatus comprising:

a body;

an image forming portion provided in the body and configured to form an image on a sheet; and a sheet feeding apparatus configured to feed a sheet to the image forming portion, the sheet feeding apparatus comprising:

a sheet storage portion configured to store a sheet and inserted to the body;

a sheet supporting member configured to support the sheet and liftable with respect to the sheet storage portion;

a lift portion configured to lift the sheet supporting member with respect to the sheet storage portion; and a damper mechanism comprising:

a movable portion supported by the sheet storage portion and configured to be moved with respect to the sheet storage portion by abutting against the body in a case where the sheet storage portion is inserted to the body;

a resistance member configured to produce a resistive force;

a first transmission portion interposed between the resistance member and the movable portion, the first transmission portion configured to actuate the resistance member to produce the resistive force and transmit resistive force to the movable portion along with movement of the movable portion, so that an insertion speed of the sheet storage portion is reduced in a case where the sheet storage portion is inserted to the body; and a second transmission portion interposed between the resistance member and the sheet supporting member, the second transmission portion configured to actuate the resistance member to produce the resistive force and transmit the resistive force to the sheet supporting member along with lowering movement of the sheet supporting member, so that a lowering speed of the sheet supporting member is reduced in a case where the sheet storage portion with the sheet supporting member having been lifted by the lift portion is drawn out of the body.

* * * * *